US012173394B2

(12) United States Patent
Bystricky et al.

(10) Patent No.: US 12,173,394 B2
(45) Date of Patent: Dec. 24, 2024

(54) METAL MATRIX COMPOSITE COMPRISING NANOTUBES AND METHOD OF PRODUCING SAME

(71) Applicant: American Boronite Corporation, Burlington, MA (US)

(72) Inventors: Pavel Bystricky, Lexington, MA (US); David S. Lashmore, Lebanon, NH (US); Iva Kalus-Bystricky, Lexington, MA (US)

(73) Assignee: American Boronite Corporation, Burlington, MA (US)

( * ) Notice: Subject to any disclaimer, the term of this patent is extended or adjusted under 35 U.S.C. 154(b) by 45 days.

(21) Appl. No.: 16/468,363

(22) PCT Filed: Dec. 29, 2017

(86) PCT No.: PCT/US2017/069051

§ 371 (c)(1),
(2) Date: Jun. 11, 2019

(87) PCT Pub. No.: WO2018/126191

PCT Pub. Date: Jul. 5, 2018

(65) Prior Publication Data

US 2020/0399748 A1 Dec. 24, 2020

Related U.S. Application Data

(60) Provisional application No. 62/440,842, filed on Dec. 30, 2016.

(51) Int. Cl.
*C22C 49/14* (2006.01)
*C22C 47/04* (2006.01)
(Continued)

(52) U.S. Cl.
CPC ..... *C22C 49/14* (2013.01); *C22C 47/04* (2013.01); *C22C 47/08* (2013.01); *C22C 47/14* (2013.01);
(Continued)

(58) Field of Classification Search
CPC ..... C22C 49/00; C22C 49/02; C22C 49/04; C22C 49/06; C22C 49/08; C22C 49/10;
(Continued)

(56) References Cited

U.S. PATENT DOCUMENTS 5,171,419 A 10/1992 Wheeler et al.
5,736,199 A 4/1998 Blucher
(Continued)

FOREIGN PATENT DOCUMENTS

EP 1 970 459 A1 9/2008
JP 2006045596 A * 2/2006
WO 2018087356 A1 5/2018

OTHER PUBLICATIONS

Zhou et al. "Fabrication and tribological properties of carbon nanotubes reinforced AI composites prepared by pressureless infiltration technique", Composites: Part A, vol. 38, pp. 301-306 (Year: 2007).*

(Continued)

*Primary Examiner* — Alexandra M Moore
(74) *Attorney, Agent, or Firm* — Hamilton, Brook, Smith & Reynolds, P.C.

(57) ABSTRACT

A metal matrix composite comprising nanotubes; a method of producing the same; and a composition, for example a metal alloy, used in such composites and methods, are disclosed. A method for continuously infiltrating nanotube yarns, tapes or other nanotube preforms with metal alloys using a continuous process or a multistep process, which results in a metal matrix composite wire, cable, tape, sheet,
(Continued)

tube, or other continuous shape, and the microstructure of these infiltrated yarns or fibers, are disclosed. The nanotube yarns comprise a multiplicity of spun nanotubes of carbon (CNT), boron nitride (BNNT), boron (BNT), or other types of nanotubes. The element that infiltrates the nanotube yarns or fibers can, for example, be alloyed with a concentration of one or more elements chosen such that the resulting alloy, in its molten state, will exhibit improved wetting of the nanotube material.

4 Claims, 12 Drawing Sheets

(51) Int. Cl.

| | |
|---|---|
| ***C22C 47/08*** | (2006.01) |
| ***C22C 47/14*** | (2006.01) |
| ***C22C 49/02*** | (2006.01) |
| ***D02G 3/04*** | (2006.01) |
| ***D04C 1/02*** | (2006.01) |
| *C22C 26/00* | (2006.01) |

(52) U.S. Cl.
CPC ..... *C22C 49/02* (2013.01); *D02G 3/04* (2013.01); *D04C 1/02* (2013.01); *C22C 2026/002* (2013.01); *D10B 2101/122* (2013.01); *D10B 2101/14* (2013.01); *D10B 2101/20* (2013.01)

(58) Field of Classification Search
CPC ..... C22C 49/11; C22C 49/14; C22C 26/00; C22C 2026/002; C22C 2026/003; D02G 3/04; D04C 1/02; D10B 2101/122; D10B 2101/14; D10B 2101/20
See application file for complete search history.

(56) References Cited

U.S. PATENT DOCUMENTS

| | | | | |
|---|---|---|---|---|
| 6,629,557 | B2 | 10/2003 | Blucher et al. | |
| 8,347,944 | B2 | 1/2013 | Nayfeh et al. | |
| 8,354,593 | B2 | 1/2013 | White et al. | |
| 8,541,335 | B2 | 9/2013 | Shugart et al. | |
| 8,541,336 | B2 | 9/2013 | Shugart et al. | |
| 8,546,292 | B2 | 10/2013 | Shugart et al. | |
| 8,551,905 | B2 | 10/2013 | Shugart et al. | |
| 8,647,534 | B2 | 2/2014 | Shugart et al. | |
| 9,000,594 | B2 | 4/2015 | Ott et al. | |
| 9,273,380 | B2 | 3/2016 | Shugart et al. | |
| 2005/0061538 | A1 | 3/2005 | Blucher | |
| 2006/0062985 | A1 | 3/2006 | Karandikar | |
| 2007/0036978 | A1* | 2/2007 | Chen | H01L 21/2885 428/408 |
| 2010/0003536 | A1* | 1/2010 | Smith | C22C 1/02 428/608 |
| 2012/0164429 | A1* | 6/2012 | Shah | B82Y 30/00 428/293.1 |
| 2014/0231118 | A1 | 8/2014 | Koziol et al. | |
| 2017/0190579 | A1* | 7/2017 | Cola | C01B 32/168 |

OTHER PUBLICATIONS

Kwon et al. "Fabrication of Functionally Graded Carbon Nanotube-Reinforced Aluminum Matrix Composite", Advanced Engineering Materials, vol. 13, No. 4, pp. 325-329 (Year: 2011).*

Chu, K., Jia, C. c., Li, W.-s. and Wang, P. (2013), Mechanical and electrical properties of carbon-nanotube-reinforced Cu—Ti alloy matrix composites. Phys. Status Solidi A, 210: 594-599. https://doi.org/10.1002/pssa.201228549 (Year: 2013).*

Liu et al. (2006) Wetting and anti-wetting on aligned carbon nanotube films Soft Matter, Feb. 2006, 811-821 (Year: 2006).*

Yu Jin, Lin Zhu, Wei-dong Xue, Wen-zhen Li, Fabrication of superaligned carbon nanotubes reinforced copper matrix laminar composite by electrodeposition, Transactions of Nonferrous Metals Society of China, vol. 25, Issue 9, pp. 2994-3001, (Year: 2015).*

Wheeler et al., "Electrodeposited Cobalt-Tungsten as a Diffusion Barrier Between Graphite Fibers and Nickel," Journal of Composites Technology & Research, JCTRER, vol. 17, No. 4, Oct. 1995, pp. 301-307.

Wheeler, "Microstructural Characterization of Cobalt-Tungsten Coated Graphite Fibers," Journal of Research of the National Institute of Standards and Technology, vol. 100, No. 6, Nov.-Dec. 1995, pp. 641-659.

A.R. Hopkins, A.C. Labatete-Goeppinger, H. Kim, H.A. Katzman, "Space survivability of carbon nanotube yarn material in low Earth orbit", Carbon 107 (2016) 77-8. DOI: 10.1016/j.carbon.2016.05.040.

Chandramouli Subramaniam, Takeo Yamada et. al. Nature Communications 4, Article No. 2202 (2013) doi:10.1038/ncomms3202.

Li, P.-C. & Young, T. K. Electromigration: the time bomb in deep-submicron ICs. IEEE Spectrum 33, 75-78 (1996).

Lloyd, J. R. & Clement, J. J. Electromigration in copper conductors. Thin Solid Films 262, 135-141 (1996).

Tao, J. & Cheung, N. W. Electromigration characteristics of copper interconnects. IEEE Electr. Device L. 14, 249-251 (1993).

Naeemi, A. & Meindl, J. D. Compact physical models for multiwall carbon-nanotube interconnects. IEEE Electr. Device L. 27, 338-341 (2006).

O. Hjortstam, P. Isberg, S. Söderholm and H. Dai, Can We Achieve Ultra-Low Resistivity in Carbon Nanotube-Based Metal Composites?, Appl. Phys. A, vol. 78, Issue 8, 2004, 1175-1179.

Zhang, S. Chen, "Electronic Structure and Transport Properties of Carbon Nanotube Adsorbed with a Copper Chain" International Journal of Nanoengineering and Nanosystems, 227, Issue 3 (Sep. 2013) 115-119.

Peng, Y. and Q. Chen, "Fabrication of Copper/Multiwall Carbon Nanotubes Hybrid Nanowires Using Electroless Copper Deposition Activated with Silver Nitrate", Journal of the Electrochemical Society, 159 Issue 2 (2012) D72-D76.

Chen Quanfang, Chai Guangyu, Li Bo. Exploration study of multifunctional metallic nanocomposite utilizing single-walled carbon nanotubes for micro/nano devices. J Nanoeng Nanosyst 2006; 219:67-72.

Sun Ying, Chen Quanfang. Diameter-dependent mechanical strength of carbon nanotubes reinforced composite. Appl Phys Lett 2009; 95:021901-3.

Chai Guangyu, Sun Ying, Sun Jianren, Chen Quanfang. Mechanical properties of carbon nanotube-copper nanocomposites. J Micromech Microeng 2008; 18:035013. http://dx.doi.org/10.1088/0960-1317/18/3/035013.

Brown, L.; Joyce, P.; Forrest, D.; Salamanca-Riba, L. Physical and mechanical characterization of a nanocarbon infused aluminum-matrix composite. ASTM Materials Performance Characterization 2014, 3(1), 65-80. DOI: 10.1520/MPC20130023.

D. R. Forrest, et al., "Novel Metal-Matrix Composites with Integrally-Bound Nanoscale Carbon", Nanotech 2012, Santa Clara, CA, Jun. 18, 2012.

D. R. Forrest, et al., "Nanoscale Carbon in Metals for Energy Applications", MS&T '12, Columbus, OH, Oct. 19, 2012.

T. Knych, et al., "Fabrication and Cold Drawing of Copper Covetic Nanostructured Carbon Composites", Arch. Metallurgy and Materials, 59(4), 1283, 2014.

L. Salamanca-Riba, et al., "A New Type of Carbon Nanostructure Formed Within a Metal-Matrix", Nanotech 2012, Santa Clara, CA, Jun. 18, 2012.

L. Pryor et al., GE Industrial White Paper (2008) http://www.geindustrial.com/publibrary/search/publication/alum-copper.

N. Frage, L. Levin, N. Frumin, M. Gelbstein, M.P. Dariel, Journal of Materials Processing, Technology vols. 143-144, Dec. 20, 2003, pp. 486-490.

CORDIS "Nanostructured Yarn Composites for Structural Energy Storage," Horizon 2020, 8 pages.

(56) References Cited

OTHER PUBLICATIONS

Mirri et al., "Lightweight, flexible, high-performance carbon nanotube cables made by scalable flow coating," ACS Appl. Mater. Interfaces 2016, 28 pages.
International Search Report and Written Opinion mailed Jun. 18, 2018 for International Application No. PCT/US2017/069051, entitled "Metal Matrix Composite Comprising Nanotubes and Method of Producing Same".
Bakshi, et al., "An analysis of the factors affecting strengthening in carbon nanotube reinforced aluminum composites," Carbon, vol. 49, pp. 533-544, 2011.
Subaramaniam, et al., "Carbon nanotube-copper exhibiting metal-like thermal conductivity and silicon-like thermal expansion for efficient cooling of electronics," Nanoscale, vol. 6, pp. 2669-2674, 2014.
International Preliminary Report on Patentability and Written Opinion issued Jul. 2, 2019 for International Application No. PCT/US2017/069051, entitled "Metal Matrix Composite Comprising Nanotubes and Method of Producing Same".

* cited by examiner

METAL MATRIX COMPOSITE COMPRISING NANOTUBES AND METHOD OF PRODUCING SAME

RELATED APPLICATION

This application is the U.S. National Stage of International Application No. PCT/US2017/069051, filed Dec. 29, 2017, which designates the U.S., published in English, and claims the benefit of U.S. Provisional Application No. 62/440,842, filed on Dec. 30, 2016. The entire teachings of the above applications are incorporated herein by reference.

BACKGROUND

Carbon nanotube (CNT) yarns, tapes or sheets typically have a density of about 9 times less than copper and about 2.7 times less than aluminum. These pure CNT conductors today can nearly match copper's specific conductivity (conductivity/density). Such CNT tapes are now used in coaxial cables as shielding and can operate at very high temperatures under much larger axial stresses and under greater fatigue constraints than copper. Cables using CNT conductors carry very high-frequency signals with great fidelity for certain space-based applications (1) (2).

Copper encapsulating individual nanotubes (not a continuous CNT yarn) results in a similar kind of material. Subramaniam et al. have shown for this kind of structure (3) that carbon nanotube-copper (CNT-Cu) hybrid composites can also transmit very high current, 600 MA $cm^{-2}$, i.e. higher by far than copper (4), (5), (6), (~1 MA $cm^{-2}$). These hybrids have an ampacity nearly at the theoretical limit (7) of CNT fibers at $10^9$ A $cm^{-2}$, although at the expense of Joule heating. In copper, ampacity is limited by electromigration, a process related to microstructure and defects. Subramaniam fabricated his conductors from dispersed forest-grown CNT electrochemically coated with only copper. However, the morphology of Subramaniam's material, although a big improvement, still fails to create good bonding between the copper and the CNT. This morphology also fails to meet the Hjortstam (8) criteria (see below) because the nanotubes are (1) not metallic conducting, (2) not aligned, and (3) not well wetted by the copper.

The ideal morphology to obtain both high current density and very high conductivity was first proposed in 2004 by Hjortstam et al., who stated: "A composite based on aligned, ballistic conducting carbon nanotubes embedded in a metal matrix might work as an ultra-low-resistive material with the potential of having a room-temperature resistivity far below Al, Cu, and Ag." Hjortstam and colleagues also posited four preconditions for these hybrids to function well:

1. High-quality (non-deformed/defective) metallic and ballistically conducting CNTs available in bulk quantities are required.
2. Well-dispersed and preferably aligned CNTs need to be established.
3. Ideally contacted nanotubes.
4. Nanotubes in which the ballistic conduction is not disturbed by the presence of the contacts or other matrix material.

Hjortstam was concerned only with conductivity, as opposed to ampacity.

There have been several approaches by different investigators which attempt to meet some of Hjortstam's criteria, including:

(1) Copper coating individual CNTs at U. of Central Florida (10) and the FP7 project by the European Community (11) to coat CNT yarn with copper.

(2) Copper coating CNTs and CNT wire: Coated carbon nanotubes have been created by several investigators, (13), (14), (15), but always with copper only. An electrochemical deposition process was used to do the copper (or copper alloy) coating on raw or pretreated (16) CNT materials. Properties depend on the defects and how well the copper coating was done, but with the exception of Subramaniam, have not been remarkable. Current carrying capacity measurements do not appear to have been made on this material (again except for Subramaniam), but there is work going on in Europe on yarns. Carbon nanotube-based copper hybrid-conductors (density ~5.2 g/cc) at copper level conductivity potentially have an ampacity of two orders of magnitude above bulk copper, as reported by Subramaniam (3).

(3) Covetics Alloys: (an alloy of carbon black with copper created by blending in the melt stage but starting with pure, unalloyed copper): These alloys of copper and graphene (18) were discovered after electrolyzing molten solutions of copper and carbon black at very high current. Since copper does not normally wet graphite, the observation of superlattices of graphene and copper by Salamanca-Riba (19) is remarkable and gives a hint of the physics behind composite graphene-copper alloys. Other investigators have used different techniques to create this same kind of alloy with the motivation being of improving corrosion resistance, increasing ampacity and increasing copper electrical conductivity. Covetics alloys (copper or aluminum based) appear to have properties significantly inferior to the Cu/CNT hybrid structures developed by Subramaniam and his colleagues, most probably due to poor graphene (from the carbon black) dispersion.

SUMMARY

Embodiments according to the present invention are related to the formation of cables with very high electrical conductivity and ampacity and more generally to methods of (1) coating a nanotube-based yarn with copper (alloy) and of (2) infiltration of a nanotube-based yarn by a metal (alloy) that wets the nanotube yarn, the composition and morphology of this alloy, and (3) a metal matrix composite with a high reinforcement density created by the nanotubes in combination with a variety of infiltrates including copper, aluminum, silver and their alloys.

In accordance with an embodiment of the invention, we disclose (1) a metal matrix composite; comprising a nanotube yarn, (2) a method of producing the yarn so that it is highly electrically conductive, (3) a composition, for example a metal alloy, used in such composites and (4) methods for continuously infiltrating nanotube yarns with metal alloys using a continuous or a batch process that results in a metal matrix composite nanotube yarn, tape, wire, cable, sheet, tube, or other object, and the microstructure of these infiltrated nanotube structures.

The nanotube yarns in accordance with an embodiment of the invention comprise a multiplicity of spun nanotubes of carbon (CNT), boron nitride (BNNT), boron (BNT) or other types of nanotubes such as, for example, boron carbo-nitride (BCN), silicon, titanium oxide, or gallium nitride. These nanotubes may be single wall, dual wall, few wall and/or multi-wall with various sizes of internal and external diameters, typically ranging from about 1 nm to 20 nm. The nanotubes preferably are 1.2 nm±0.1 nm. The nanotubes may be replaced by carbon fibers which are not hollow on the inside. Some nanotube yarns or fibers can be infiltrated with an element such as copper, aluminum, silver, gold, zinc, lead, tin or magnesium or combinations. The element that infiltrates the nanotube yarns or fibers can, for example, be alloyed with a concentration of one or more elements chosen such that the resulting alloy, in its molten state, will exhibit improved wetting of the nanotube material. Some examples of these include Cr, Sc, Ti, V, Hf, Nb, Al, W, Mo, Ta, Ni, Co, Fe, Si, Rh or Zr. For some elements that infiltrate the nanotube yarns or fibers (for example, aluminum), alloying may not be necessary, in which case, for example, a pure metal such as pure aluminum may be used, as taught further herein. Infiltration means in this case that the fibers or nanotubes and or bundles of nanotubes are substantially surrounded by the matrix element(s). In some cases, diffusion may be fast enough that the alloys do not have to melt in order to be fully infiltrated.

In accordance with an embodiment of the invention, there is produced a new class of material, which can, for example, be referred to as a "Superwire," herein. For example, a Superwire in accordance with an embodiment of the invention can comprise copper or copper-alloy infiltrated around the nanotubes or bundles of nanotubes within a continuous carbon nanotube yarn. A Superwire in accordance with an embodiment of the invention can exhibit a combination of extraordinary properties that include high strength, high current carrying capacity, along with good thermal conductivity and high electrical conductivity.

In accordance with an embodiment of the invention, an infiltration process is facilitated by appropriate elemental metal choices that promote wetting, thereby enabling strong capillary forces to fill the nanotube structure which includes yarns, tapes sheets or other preforms. In an embodiment, the process for example may consist of two parts or steps: (1) placing a nanotube yarn in contact with a molten alloy, and (2) heating and allowing capillary forces to aid in infiltration. In some cases, it might be advantageous to continuously pull the yarn through a die to promote infiltration or wetting. In some cases, alloying is not necessary, and a molten pure metal may be used. An example of this is aluminum infiltrated CNT yarn. In some cases, the alloy can be coated onto the surface as a solid (by electrodeposition for example) and subsequently used as is, or heat treated, or pulled through a die, to form the infiltrated composite.

The present invention provides, in accordance with one embodiment, a high current carrying conductor or Superwire. In this embodiment, the conductor consists of a carbon nanotube fiber or yarn infiltrated with a copper alloy engineered to wet the CNT surface. This conductor may, for example, have electrical conductivity higher than copper and may have current carrying capacity or ampacity much higher than copper, such as, for example, two orders of magnitude higher. Ampacity is defined as the maximum current density which can be applied to a conductor without a change in its resistivity. This composite conductor can, for example, have the additional ability to suppress electromigration when the Superwire is operated at high current densities and or temperature. Electric current is carried by both the copper and the carbon nanotubes.

The present invention provides, in accordance with another embodiment, a method for making the conductor by using a copper alloy composition chosen to form a strong and electrically well-connected interface with the nanotube yarn or fiber.

The present invention provides, in accordance with another embodiment, a means of producing a high strength metal matrix composite with a degree of nanotube loading difficult to achieve by any other processing technique. This metal matrix composite will possess very good thermal properties, good electrical properties, engineered coefficient of thermal expansion and superior mechanical properties compared to copper. In addition, this composite material will be resistant to externally applied heat even in air. Applications of an embodiment according to the invention are wide ranging, but some of these include: (1) conducting wires or cables that are lighter than copper and provide higher ampacity than copper (for example, a "Superwire"), (2) composites that are electrically and thermally conductive and are very resistant to plasma damage, (3) carbon nanotube composites used for battery electrodes (CNT-reinforced lead or tin), (4) aluminum or aluminum alloy CNT reinforced cables and a variety of other composites, (5) carbon nanotube sheet-electrodes or composites used for removing heat, say for batteries which create heat by charging or discharging and (6) objects such as pre-formed composites such as housings for plasma arc devices.

In summary the present invention embodiments provide a means for creating electrical and/or thermal conductors by infiltration of copper or aluminum into a nanotube yarn (CNT, BNNT, B or other nanotubes), tape or sheet by: (1) infiltration of the yarn, tape or sheet using molten alloy. (2) coating of the nanotube yarn or tape combined with heat treatment to infiltrate, (3) coating of the nanotube yarn or tape without infiltration, (4) processing methods to create a continuous CNT yarn or tape that consists primarily of metallic conducting CNTs that can serve as a substrate for the other processes.

In accordance with an embodiment of the invention, there is provided a metal matrix composite. The composite comprises: a metal and a plurality of nanotube reinforcements present in a volume fraction of between about 10% by volume and about 90% by volume of the metal matrix composite. The metal matrix composite comprises a continuous structure comprising the metal and the plurality of nanotube reinforcements.

In further, related embodiments, the plurality of nanotube reinforcements may comprise at least one of carbon nanotubes, boron nitride nanotubes, boron nanotubes, boron carbo-nitride nanotubes, silicon nanotubes, titanium oxide nanotubes and gallium nitride nanotubes. The metal may comprise at least one of copper, aluminum, silver, gold, tin, cobalt, nickel and iron. The plurality of nanotube reinforcements may be present in a volume fraction of between about 40% by volume and about 60% by volume of the metal matrix composite. The metal may comprise at least one of: chromium, scandium, titanium, vanadium, hafnium, niobium, aluminum, tungsten, molybdenum, tantalum, nickel, cobalt, iron, silicon, ruthenium and zirconium. The metal may comprise an alloy of a metal of at least about 90% purity and the at least one of: chromium, scandium, titanium, vanadium, hafnium, niobium, aluminum, tungsten, molybdenum, tantalum, nickel, cobalt, iron, silicon, ruthenium and zirconium. The metal matrix composite may comprise between about 0.5% by weight and about 15% by weight, such as between about 0.5% by weight and about 2% by weight, of the at least one of: chromium, scandium, titanium, vanadium, hafnium, niobium, aluminum, tungsten, molybdenum, tantalum, nickel, cobalt, iron, silicon, ruthenium and zirconium. The plurality of nanotube reinforcements may comprise a continuously spun nanotube yarn or a continuous nanotube tape, and the metal may comprise copper alloyed with at least one of: chromium, scandium, titanium, vanadium, hafnium, niobium, aluminum, tungsten, molybdenum, tantalum, nickel, cobalt, iron, silicon, ruthenium and zirconium. The continuously spun nanotube yarn or the continuous nanotube tape may comprise a carbon nanotube continuous yarn or tape, and the metal may comprise a copper-titanium alloy comprising between about 0.1% by weight titanium and about 5% by weight titanium. The plurality of nanotube reinforcements may comprise a continuously spun nanotube yarn or a continuous nanotube tape, and the metal may comprise substantially pure aluminum. The continuously spun nanotube yarn or continuous nanotube tape may be embedded in a matrix of the metal. The metal may be wetting the plurality of nanotube reinforcements. Beads of the metal may form a contact angle of less than 90 degrees with nanotubes of the plurality of nanotube reinforcements.

In other related embodiments, the metal matrix composite may comprise a first layer of metal coating the plurality of nanotube reinforcements, and a second layer of metal coating the first layer of metal. The first layer of metal may comprise at least one of: chromium, scandium, titanium, vanadium, hafnium, niobium, aluminum, tungsten, molybdenum, tantalum, nickel, copper, cobalt, iron, silicon, ruthenium and zirconium; and the second layer of metal may comprise a pure metal. The second layer of metal may comprise copper of at least about 90% or greater purity, and the plurality of nanotube reinforcements may comprise a continuous carbon nanotube wire or yarn. The continuous structure of the metal matrix composite may comprise at least one of a continuous yarn, a continuous wire, a continuous cable, a sheet, and a preformed nanotube shape.

In further related embodiments, there is provided an interdiffused alloy composite resulting from heating of the metal matrix composite described above, the interdiffused alloy composite comprising materials of the first layer of metal and of the second layer of metal substantially filling the space around the plurality of nanotube reinforcements.

In another embodiment according to the invention, there is provided an interdiffused alloy composite resulting from heating of a composite structure comprising a metal including one or more of chromium, scandium, titanium, vanadium, hafnium, niobium, aluminum, tungsten, molybdenum, tantalum, nickel, copper, cobalt, iron, silicon, ruthenium and zirconium, coated onto a carbon structure, sufficiently for the metal to substantially fill the voids within the carbon structure.

In a further, related embodiment, the carbon structure may comprise at least one of a nanotube yarn, a nanotube tape, a nanotube wire, a nanotube cable and a graphene yarn. The composite may further comprise a carbon fiber.

In other related embodiments, there is provided a braided yarn or cable comprising the metal matrix composite taught herein. The braided yarn or cable may further comprise insulation and at least one connector.

In another embodiment according to the invention, there is provided a method of forming a metal matrix composite. The method comprises: combining a continuous nanotube structure with a metal to create an infiltrated metal matrix nanotube structure, and heating the infiltrated metal matrix nanotube structure to a temperature exceeding a melting point of a metal of the infiltrated metal matrix nanotube structure, the heating comprising at least one of: (i) passing the infiltrated metal matrix nanotube structure through a heated die, at least a portion of which exceeds a melting point of a metal of the infiltrated metal matrix nanotube structure; (ii) heating the infiltrated metal matrix nanotube structure in a tube furnace; (iii) laser heating the infiltrated metal matrix nanotube structure; (iv) plasma heating the infiltrated metal matrix nanotube structure; or (v) resistive heating of the infiltrated metal matrix nanotube structure; the method being performed in a controlled atmosphere.

In further related embodiments, the method may be used to form any of the metal matrix or composites taught herein. The method may comprise passing the continuous nanotube structure via pulleys through the molten metal. The continuous nanotube structure may comprise at least one of a nanotube yarn, a nanotube wire, a nanotube cable, a nanotube sheet, and a preformed nanotube shape. The method may further comprise braiding the metal matrix composite to form at least a portion of a hollow tube, a braided yarn or a cable.

In another embodiment according to the invention, there is provided a method of forming a metal matrix composite. The method comprises: surrounding a continuous nanotube structure with a metal structure; and in a controlled atmosphere, heating the surrounded continuous nanotube structure to a temperature exceeding a melting point of a metal of the metal structure or a temperature high enough to cause infiltration of a metal of the metal structure around the nanotubes, the heating comprising at least one of: (i) passing the surrounded continuous nanotube structure through a heated die, at least a portion of which exceeds a melting point of a metal of the metal structure; (ii) heating the surrounded continuous nanotube structure in a tube furnace; (iii) laser heating the surrounded continuous nanotube structure; (iv) plasma heating the surrounded continuous nanotube structure; or (v) resistive heating of the surrounded continuous nanotube structure.

In further, related embodiments, the method may comprise surrounding the continuous nanotube structure with the metal structure, prior to heating, by at least one of: (1) electrochemical coating of the continuous nanotube structure with the metal structure using metal from aqueous electrolytes, organic electrolytes or fused salts; and (2) sputtering an alloy composition onto the continuous nanotube structure; or (3) plasma coating; or (4) powder infiltration or (5) physical vapor deposition coating. The continuous nanotube structure may comprise at least one of: a nanotube yarn, a nanotube wire, a nanotube sheet, a nanotube cable, and a preformed nanotube shape. The method may comprise forming any of the metal matrix composites taught herein. The method may further comprise braiding the metal matrix composite to form at least a portion of a hollow tube, a braided yarn or a cable.

In further, related embodiments, a method may comprise forming the metal matrix composite with a slight excess of a metal to produce a pre-impregnated structure; consolidating a plurality of the pre-impregnated structures into a net shape; and heating the net shape, thereby creating a reinforced metal matrix composition structure. A plurality of nanotubes of the reinforced metal matrix composite structure may be aligned. The reinforced metal matrix composite structure may comprise at least one of carbon nanotubes, boron nitride nanotubes, boron nanotubes, boron carbonitride nanotubes, silicon nanotubes, titanium oxide nanotubes and gallium nitride nanotubes.

In another embodiment according to the invention, there is provided a method of forming a metal matrix composite, the method comprising: mixing (i) a molten metal, (ii) a carbon source; and (iii) at least one of: chromium, scandium, titanium, vanadium, hafnium, niobium, aluminum, tungsten, molybdenum, tantalum, nickel, cobalt, iron, silicon, ruthenium and zirconium; thereby producing the metal matrix composite.

In further related embodiments, the carbon source may comprise at least one of carbon black, graphene, carbon nanotubes and carbon fiber. The metal may comprise at least one of copper, aluminum, silver and gold of a purity greater than about 90%. The method may comprise mixing the molten metal and the carbon source with between about 0.5% by weight and about 15% by weight, such as between about 0.5% by weight and about 2% by weight, of the at least one of: chromium, scandium, titanium, vanadium, hafnium, niobium, aluminum, tungsten, molybdenum, tantalum, nickel, cobalt, iron, silicon, ruthenium and zirconium.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

FIG. 10A and corresponding spectrum in FIG. 10B show that the section of Superwire was substantially infiltrated with the metal alloy. FIG. 10C and spectrum in FIG. 10D confirm that background is metal only.

DETAILED DESCRIPTION

Figure 1:
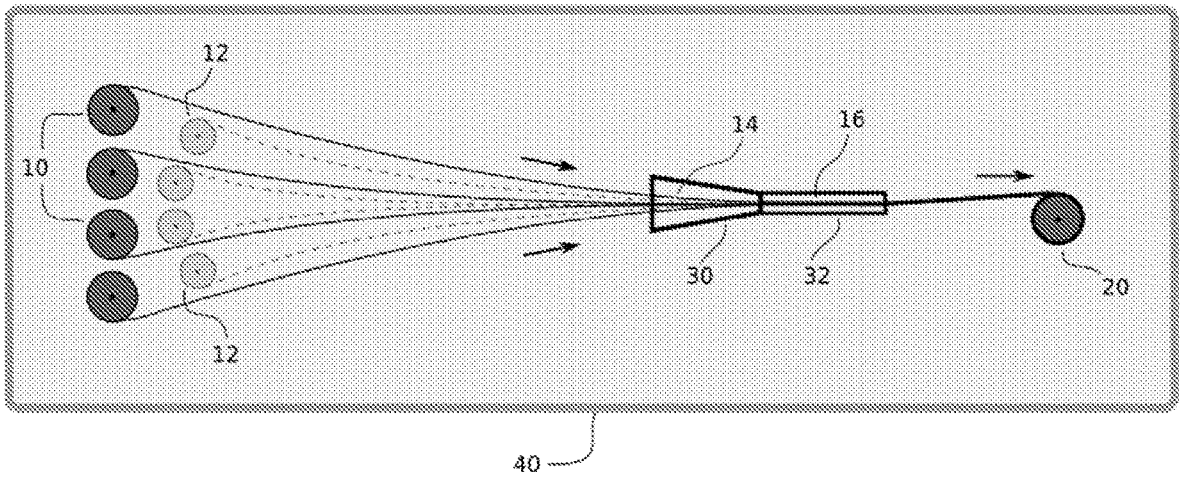
FIG. 1 illustrates a technique for producing continuous Superwire material, in which nanotube yarns along with metal wires are pulled through a heated die to melt the metal, in accordance with an embodiment of the invention.

A description of example embodiments follows.

An embodiment according to the invention aims to meet the challenge of satisfying the preconditions set forth by Hjortstam et al., discussed above, for providing a morphology of nanotubes in a metal matrix composite that obtains both high current density and very high conductivity. For example, one embodiment according to the invention increases the conductivity of carbon nanotube (CNT) (or other types of nanotube taught herein) continuous wire by; (1) controlling their microstructure during growth, and (2) by infiltrating the carbon nanotubes (as opposed to coating them) with elements (for example, a metal such as copper, aluminum, silver, gold, nickel, iron, cobalt or an alloy including such metals that wet the individual nanotubes and that may serve as alloying elements). Copper alloy compositions have been developed in accordance with an embodiment of the invention.

An embodiment according to the invention is believed to be able to meet the preconditions set forth by Hjortstam and colleagues, discussed above, for providing a morphology of nanotubes in a metal matrix composite that obtains both high current density and very high conductivity.

Regarding the first precondition of Hjortstam et al., high-quality (non-deformed/defective) metallic and ballistically conducting CNTs can be used. High-quality and ballistically conducting means nanotubes with a minimal number of structural or crystallographic defects, such as for example Stone-Wales defects.

In addition, we posit that semiconducting nanotubes of small bandgap can be used, to meet the first precondition of Hjortstam et al., if they are long compared with the ballistic mean free path (10 microns) and have a low defect density. Low means fewer than one defect every 10 microns. There is no advantage to having only metallically conducting nanotubes if their length is less than the mean free path. It is important to have few defects in these nanotubes.

The second precondition of Hjortstam et al., well-dispersed and preferably aligned CNTs, means that most of the nanotubes should be aligned along the electric field axis or yarn/wire axis. In accordance with an embodiment of the invention, well-dispersed CNTs (and their bundles) are established, by capillary forces and/or pressure infiltration, and the alignment of the CNTs is accomplished, for example, by using aligned yarns, aligned tapes or sheets.

The third precondition of Hjortstam et al., ideally contacted nanotubes, means that the nanotubes should be in electrical contact with the metal (i.e. should be wetted by the metal) and/or should be in electrical contact with each other. In accordance with an embodiment of the invention, contacting of the nanotubes is accomplished by wetting, for example in Cu—Ti/CNTs. (Ti may be replaced by Zr, Cr, Ni, Co or other alloy former).

The fourth precondition of Hjortstam et al. (nanotubes in which the ballistic conduction is not disturbed by the presence of the contacts, defects, inclusions, or other matrix material), means that there should not be any contamination layer between the nanotubes and metal that might interfere with electron transport. In accordance with an embodiment of the invention, this can be accomplished by CNT yarns grown at high temperatures, ranging from 1250 to 1500° C., optimally at 1350° C. and in highly balanced gas chemistries and designing the catalyst generator to product catalyst diameters of about 1 to 15 nm but preferably 1.2 nm±0.2 nm, and by tailoring the metal alloy composition in a manner that will optimize wetting of the CNTs without any detrimental interfacial reaction products.

In addition, whereas the work of Hjortstam et al. was concerned with only conductivity, an embodiment according to the invention is believed to enhance ampacity, either by dispersing nanotubes, such as carbon nanotubes, within a metal such as copper or by infiltrating as opposed to coating, the complex yarn CNT network with copper. Furthermore, in an embodiment according to the invention, CNTs act to reduce electromigration in the matrix.

A benefit of the approach presented in accordance with an embodiment of the invention is that the CNTs themselves provide a barrier to electromigration of the copper both directly and through the stress fields that they set up within the composite. It was found by Subramaniam that the current carrying capacity could be increased by almost two orders of magnitude in composites of the type investigated by Subramaniam; however the conductivity in their material was about the same as copper. An embodiment according to the present invention has the potential to increase conductivity above the copper level In accordance with an embodiment of the invention, infiltrating CNT yarn with copper also takes advantage of the very high CNT charge carrier mobility and sharing of the large number of charge carriers in copper with CNTs which have few charge carriers by comparison. The demonstrated suppression of electromigration by CNTs within copper can provide ampacity increases, in accordance with an embodiment of the invention.

Without wishing to be bound by theory, it is also suggested that, because of the mobility differences, the very high charge mobility of the CNT yarns in accordance with an embodiment of the invention will help provide a channel to conduct charges more efficiently than using copper by itself, additionally yielding conductivities even higher than copper.

Whereas prior work, such as that of Subramaniam et al. (3), does not provide a continuous wire (in this case a conductor indefinitely long), an embodiment according to the present invention permits the producing of a continuous wire, for example from a continuous CNT yarn. In addition, an embodiment according to the present invention permits wetting of nanotubes, in accordance with the teachings herein.

Significant efforts have been expended over the past twenty-five years to develop commercial applications for nanotubes, particularly; (1) carbon nanotubes (CNTs) but also to a lesser extent other similar systems such as (2) boron nitride nanotubes (BNNTs) and (3) boron nanotubes (BNTs). An embodiment according to the present invention encompasses all three kinds of nanotube yarns or fibers, and other nanotubes or solid carbon fibers consistent with the teachings herein. The perfect hexagonal arrangement and covalent bonding between atoms in CNTs and BNNTs provides many outstanding properties, including very high strength combined with very low density. CNTs and BNNTs are among the strongest structural materials known. Although BNTs lack the same hexagonal symmetry, they may potentially provide even better conductivity than CNTs, BNNTs and BNTs, and also provide excellent neutron shielding.

In another embodiment of this invention, by using one of the methods taught herein to create a metal pre-impregnated matrix (which is also referred to as a "prepreg," herein) with a slight excess of metal alloy (or in some cases, a pure metal), a new metal matrix composite structure can be created. In accordance with an embodiment of the invention, these prepregs can be consolidated into a net shape structure by filament or tape winding followed by consolidation by hot isostatic compaction, hot pressing, sintering, laser sintering or hot compaction. It now becomes possible, in accordance with an embodiment of the invention, to bond the preforms together into a solid pore-free structure. The resultant structure will not generally exhibit isotropic properties due to fiber alignment. However, in accordance with an embodiment of the invention, multiple layers can be rotated with respect to each other, to approximate a homogenous structure. The consequence of an embodiment according to the invention is that one can create a metal matrix composite with a high (and, in some cases, an almost ideal) density of CNT, BNNT, or BNT, with the fibers and therefore the nanotubes aligned along one axis with high conductivity and, for example, in the case of Cu-CNTs, very high electrical conductivity, thermal conductivity, and ampacity.

In general, in conventional practice, the achievement of an ideal packing density in a composite is a challenge. A single nanotube length may reach millimeters or even centimeters in extreme cases but with a diameter on the order of a few nanometers. The problem is how to fill space efficiently with nanotubes while transmitting the property of interest (load, heat, electric current) along the fiber. Generally speaking it is relatively easy to greatly increase the electrical conductivity of a polymer by dispersing a low volume of CNTs within the polymer matrix: all that is required is to exceed the percolation threshold, which in this case is only on the order of 1 percent by volume. For structural applications in general, however, a significant increase in strength will only be achieved if the composite includes a large fraction of reinforcement, i.e. of nanotubes in the present case. High strength composites such as carbon fiber reinforced epoxies typically contain 55 to 70% reinforcement by volume. Incorporating nanotubes in powder form (i.e. individual, loose nanotubes) into a matrix at such high-volume fractions is difficult, if not impossible, because of the extremely high viscosity caused by the large specific surface area of the nanotube. Typical concentrations of CNTs in composite matrices are usually 10% or less due to the viscosity issues mentioned above. Even if a method can be developed to produce composite structures with a very high fraction of well distributed, randomly arranged nanotubes, such a reinforcement geometry may not be ideal for optimal load transfer within the composite, or for improving the electrical properties of the composite, due to difficulty in alignment of the individual nanotubes within the matrix and bonding of the nanotube to the matrix.

Conventionally, in the case of metal matrix composites (MMCs), difficulties in processing are further compounded by additional factors. The high melting point of most metals of interest means that liquid infiltration is challenging both from the standpoint of safety and from the standpoint of excluding air from the system. Processing methods at temperatures below the melting point such as powder sintering, or reactive sintering is generally not an option for infiltrating compact reinforcement preforms aimed at increasing conductivity and, in any case, these typically lead to significant residual porosity. Hot isostatic pressing can be used to get very high density but it is not a continuous process and is costly. High temperature processing requirements necessitate additional precautions to prevent damage to certain types of reinforcement. For example, carbon-based reinforcements must be processed in an oxygen-free environment. CNTs will start to oxidize in air at temperatures as low as 350° C. Furthermore, even at high temperature and under vacuum, most metals, especially if they don't "wet" the fibers, will not readily infiltrate small interstices inside compact preforms and will benefit from the application of high pressure.

An additional consequence of liquid metal infiltration is the creation, in many systems, of detrimental reaction phases at the metal-reinforcement interface. An example is the formation of aluminum carbides during infiltration of carbon fibers with aluminum. In other cases, such as for pure liquid copper infiltrated into alumina or carbon nanotube fibers, poor or no wetting of the fiber results in very weak interfacial bonding, poor electrical contact, and poor mechanical properties.

Therefore, it is desirable to develop methods for producing nanotube-reinforced composites with a high volume fraction of reinforcement. A process which enables full infiltration of densely packed nanotube yarn, tape or preforms while providing a strong, reaction-free but adherent interface would produce a material that takes full advantage of the extraordinary properties—mechanical, electrical, thermal shielding, damping—of nanotube structures such as yarns, tapes, sheets or preforms and extend their use to real-world applications at the macro scale. An embodiment according to the present invention specifically addresses a solution to these fundamental problems.

A subclass of the MMC wires, in accordance with an embodiment of the invention can be used as electrical conductors which could potentially replace copper and aluminum wires for applications: (1) in motors, alternators and generators, solenoids used for automotive and aerospace fields, (2) for wiring used in high current pulse applications and especially for wiring that has to be very strong, (3) in high voltage power transmission lines, and (4) for very low temperature applications, (5) for wiring that has to survive in extreme high temperatures and/or corrosive environments, (6) for wiring that has to be very fatigue resistant, (7) for wiring that has to be placed under the ocean, (8) for wiring used in antennas, (8) for other very high ampacity applications such as rail gun cables and rails, printed circuit board or chip wiring, (9) for composite materials used in high energy plasma housings or (10) to replace copper tungsten as a direct die attach heat sink for wiring within the human body that has to be very corrosion resistant for example to power batteries. Nominally pure 98% conductivity IACS (International Annealed Copper Standard) copper and aluminum 6101 are commonly used alloys for electrical conductors (20). Other popular aluminum alloys include 1100, 5056—a pure aluminum clad alloy, 6061 and 1350. Copper, used in most motor windings and home wiring applications has a high density and is prone to corrosion and fatigue failure. Aluminum has much lower density and lower cost, and is used in commercial wiring and power lines although it is even more susceptible to corrosion than copper. Aluminum also presents a safety risk in some cases because of the potential for faulty connections due to the formation of insulating aluminum oxide. The conductivity of 6101 Al is only 56% that of copper. A consequence of the lower conductivity is that for the same current carrying capacity (ampacity), an aluminum conductor must have a larger cross-sectional area than a copper conductor and cannot be bent with as tight a radius as copper.

Generally speaking, the main factor limiting high current densities, in conventional conductors made of copper and other metals, is electromigration of the atoms of the conductor and/or impurity atoms, in this case copper, aluminum, silver or gold. (Impurity atoms can, to some extent, reduce the electromigration effect, for example when palladium, zirconium, or titanium is added to copper or copper is added to aluminum). This phenomenon is a structure sensitive property and can be effectively suppressed by a dense network of nanotubes within the wire, preferably carbon nanotubes. An embodiment according to the present invention solves one of the key barriers to the creation of Superwires on a commercial scale by enabling copper to be almost ideally distributed within a high density, indefinitely long, carbon nanotube fiber composite.

The copper-CNT Superwire, in accordance with the first embodiments of the invention herein, is a new class of conducting material which has a greater ampacity and better conductivity than standard copper wire. As such it would have a great impact on a range of important applications from high-voltage power lines, very high current pulsed wires (for example for use in rail guns), and electrical motor windings for cars, buses and other similar applications.

Control of the coefficient of thermal expansion (CTE) is another area in which nanotube reinforcement of metal wires can have a great impact for some applications. Metals such as copper and aluminum are commonly used in applications such as interconnects or heat sinks where their high electrical or thermal conductivity are beneficial but their relatively high CTE causes a problematic mismatch with the substrate. In accordance with an embodiment of the invention, a metal-nanotube MMC creates the opportunity to tailor the CTE by adding reinforcement with very low (or even negative) CTE to engineer the thermal expansion to match that of the substrate while maintaining very high thermal and electrical properties.

FIG. 1 illustrates a technique for producing continuous Superwire material, in which nanotube yarns along with metal wires are pulled through a heated die to melt the metal, in accordance with an embodiment of the invention. In addition, or alternatively, these nanotube yarns can also be pre-coated, for example by electrodeposition, prior to melting and passing through the die. In FIG. 1, yarn(s) composed of continuously spun nanotubes is (are) unspooled from bobbin(s) 10. Metal wire is unspooled from bobbin(s) 12. The number of nanotube bobbins 10, the weight per length (measured for example in Tex [g/1000 m] or denier [g/9000 m]) of nanotube yarn, the number of metal wire bobbins 12 and the metal wire gauge are chosen according to the proportions which will yield the desired fraction of reinforcement in the finished product. The nanotube yarns and metal wires form a bundle 14 as they enter the initial section 30 of a die assembly (30+32). Section 30 is heated to a temperature just below the melting point of the metal wires. Heating of die section 30 and 32 may be accomplished via an external heat source or by Joule heating of the nanotube yarn, for example by applying an electrical current to a section of a CNT yarn. The bundle is pulled through section 32 of the die assembly, which is heated to a temperature slightly exceeding the melting point of the metal wires. As bundle 14 is pulled through die 32, the metal wires melt and infiltrate the nanotube network, forming a metal matrix composite Superwire with a liquid matrix 16. At the exit of die 32, Superwire 16 is cooled to below the matrix melting point, allowing the composite to solidify to its final net shape. Superwire 16 is then spooled onto take-up bobbin 20. The entire apparatus is kept inside a hermetically sealed enclosure 40, which allows the process atmosphere to be controlled. In accordance with embodiments of the invention, the process may be performed in a controlled atmosphere; for example, enclosure 40 may be filled with argon gas to prevent oxidation of the nanotube and metal constituents, which could occur as a consequence of contact with air at the high metal processing temperatures. Other controlled atmospheres can be used, for example to prevent oxidation. In some embodiments, a support structure may be used to provide support to the bundle 14 as it travels through the die 32, for example where the bundle 14 would otherwise break for lack of mechanical support during melting in the die 32. In one example, a carbon fiber may be used as such a support structure, and may be removed as the Superwire 16 is spooled onto the take-up bobbin 20.

Figure 2:
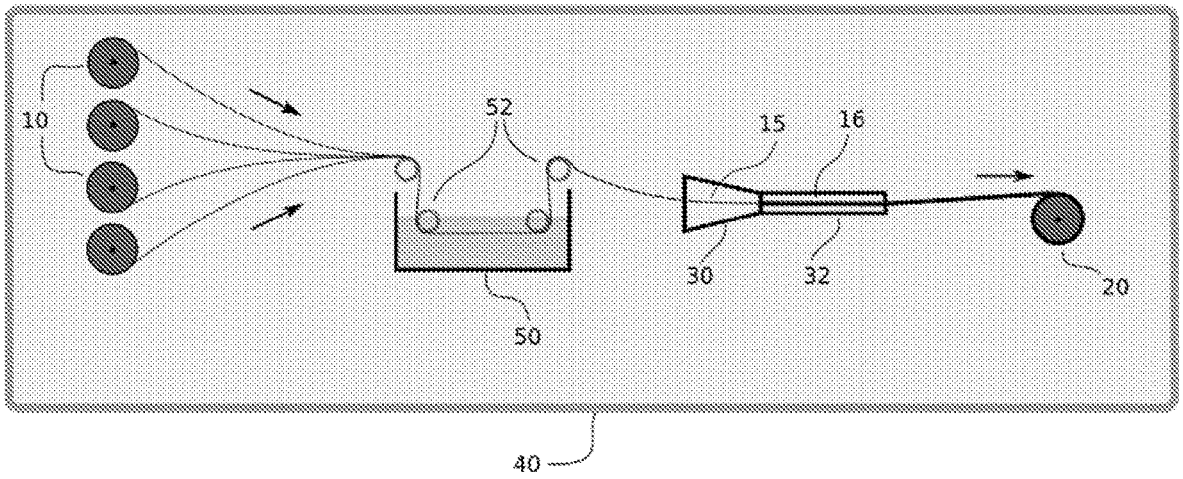
FIG. 2 illustrates an alternative technique for processing Superwire material, in which nanotube yarns are first pulled through a vessel containing molten metal and then through a heated die, in accordance with an embodiment of the invention.

FIG. 2 illustrates an alternative technique for processing Superwire material, in which nanotube yarns are first pulled through a vessel containing molten metal and then through a heated die, in accordance with an embodiment of the invention. In FIG. 2, yarn(s) composed of continuously spun nanotubes is (are) unspooled from bobbin(s) 10 and pulled over/under pulleys 52 through or over the molten matrix metal 50. It may be sufficient in some cases, in accordance with an embodiment of the invention, to run the yarn above the molten metal, rather than through it. As the yarn moves through (or over) the melt 50, molten metal infiltrates pores and open channels present between nanotubes and/or between bundles of nanotubes inside the spun yarn, creating a pre-impregnated MIVIC yarn 15. Following this step, yarn 15 is pulled through a heated die assembly (30+32) similar to that presented in FIG. 1. In this case, however, both portions of the die (30 and 32) are heated to a temperature slightly exceeding the melting point of the metal to prevent premature solidification of the matrix. In die section 32, the orifice has a conical shape whose cross-section becomes progressively smaller from left to right in FIG. 2, until the cross-section reaches the diameter chosen for the finished MIVIC Superwire 16. As yarn 14 moves through die 32, excess metal gets squeezed out to reach the desired reinforcement fraction and geometry of the final product 16. Similarly to the case of FIG. 1, Superwire 16 is cooled at the exit of die 32 to below the matrix melting point, allowing the composite to solidify to its final net shape. Superwire 16 is then spooled onto take-up bobbin 20. The entire apparatus is kept inside a hermetically sealed enclosure 40, which allows the process atmosphere to be controlled. The Superwire thus produced can be post-processed by weaving or braiding into a cable, a tape or a sheet, or alternatively it can be 3-D woven into a structure which itself can be consolidated by any number of means know in the art, such as HIPing, hot pressing or sintering.

Figure 3:
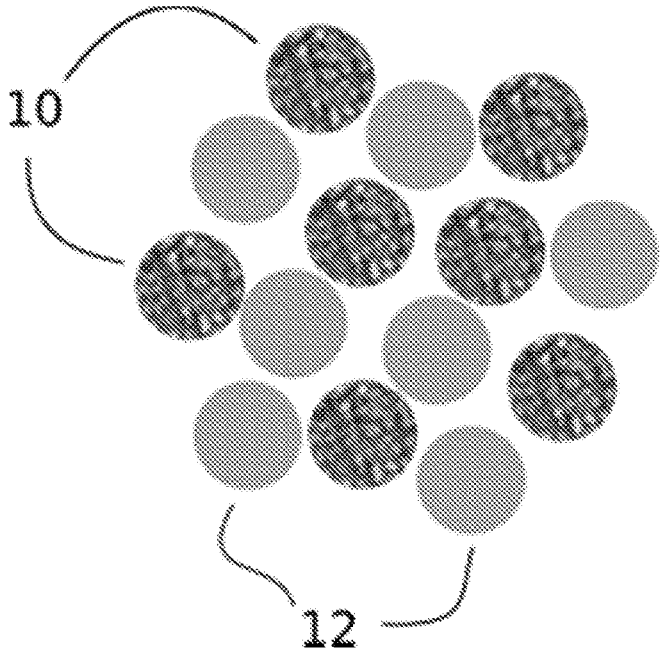
FIG. 3 illustrates a cross-section of the fiber bundle 14 from FIG. 1, in accordance with an embodiment of the invention.

FIG. 3 illustrates a cross-section of the fiber bundle 14 from FIG. 1, in accordance with an embodiment of the invention. In FIG. 3, the fiber bundle 14, composed of nanotube yarn 10 and metal wire 12, is shown in cross-section before it is pulled through the heated die. The number and size of the wires of each type may be varied (from a single nanotube yarn and a single metal wire to multiple yarns and wires, not necessarily in equal numbers or of equal diameters), depending on the desired composition of the final product.

Figure 4:
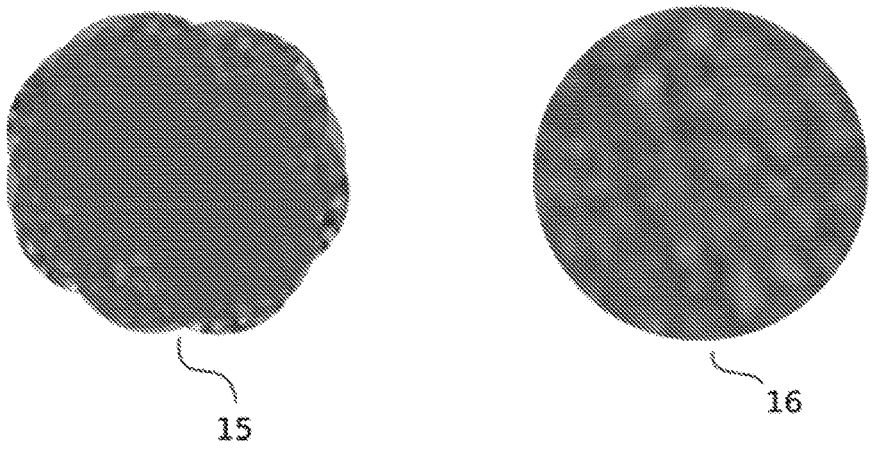
FIG. 4 illustrates on the left a cross-section of the infiltrated bundle 15 from FIG. 2 before it undergoes metal squeeze-out and on the right a cross-section of the final Superwire product 16, in accordance with an embodiment of the invention.

FIG. 4 illustrates on the left a cross-section of the infiltrated bundle 15 from FIG. 2 before it undergoes metal squeeze-out and on the right a cross-section of the final Superwire product 16, in accordance with an embodiment of the invention. In FIG. 4, the infiltrated nanotube yarn 15 is shown in cross-section before metal squeeze-out, illustrating some non-uniformity in metal and reinforcement distribution. The final product 16 is illustrated with complete infiltration and uniform nanotube distribution.

Figure 5:
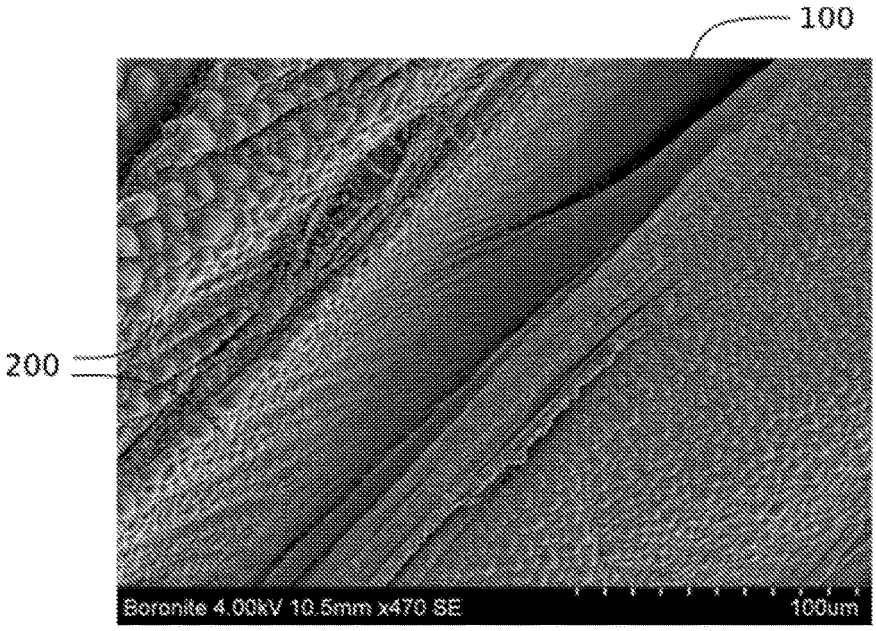
FIG. 5 shows a scanning electron microscope (SEM) image of a network of CNTs infiltrated with a low alloy copper matrix, in accordance with an embodiment of the invention.
Figure 6A:
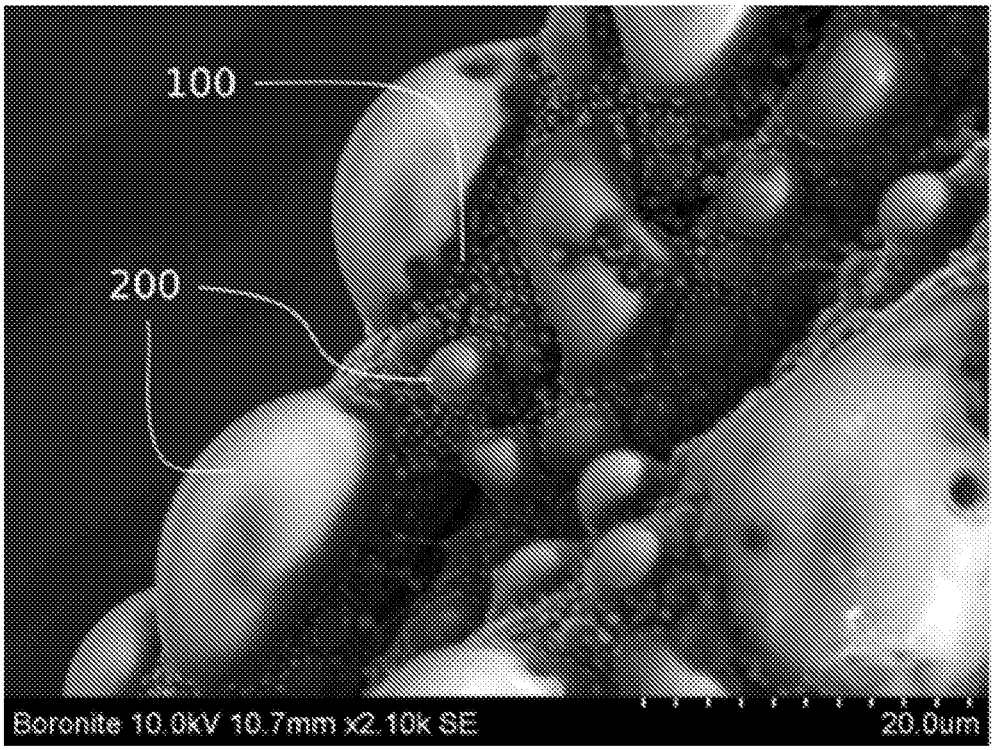
FIG. 6A shows a higher magnification detail of FIG. 5, in accordance with an embodiment of the invention.
Figure 6B:
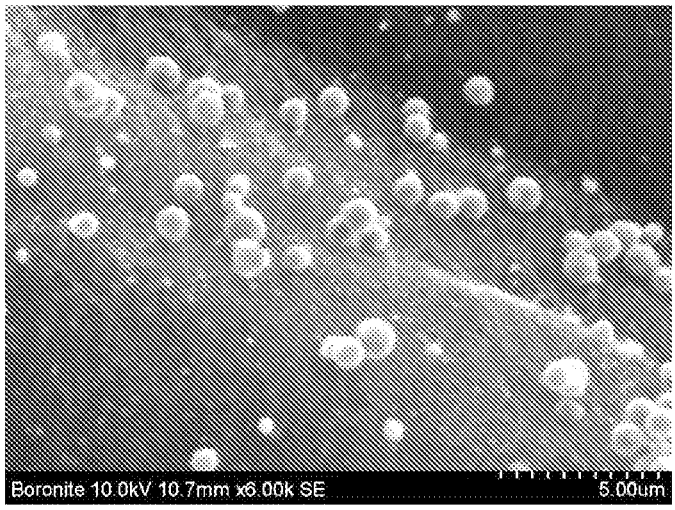
FIG. 6B shows an example of poor wetting with insufficiently alloyed copper.

FIG. 5 shows a scanning electron microscope (SEM) image of a network of CNTs infiltrated with a low alloy copper matrix, in accordance with an embodiment of the invention. FIG. 6A shows a higher magnification detail of FIG. 5, in accordance with an embodiment of the invention. In FIGS. 5 and 6A, good wetting of a CNT network 100 by a low alloy copper matrix 200 is demonstrated. The higher magnification detail presented in FIG. 6A demonstrates the low contact angle (less than 90°, i.e. good wetting) of beads of metal 200 on the carbon network 100. Good wetting by molten metal, and thus good infiltration of the nanotube network, is achieved by adding low levels (such as 2% by weight or less, or such as 1% by weight or less) of alloying elements to the matrix metal. The alloying elements include, but are not restricted to, the following list: Cr, Sc, Ti, V, Hf, Nb, Al, W, Mo, Ta, Ni, Co, Fe, Si, Rh or Zr. When there is no wetting (unlike the wetting that can, for example, be achieved using the foregoing elements), instead of spreading easily by capillary forces onto the nanotube network and infiltrating it, the molten metal would form spherical beads with contact angles greater than 90° with the surface. An example of this is shown in FIG. 6B. This makes infiltration difficult and results in very poor bonding at the interface between metal and reinforcement, causing brittleness and poor mechanical properties of the MMC. Wetting can also be promoted by chemical and electrochemical surface modification such as by anodizing for short times.

Figure 7:
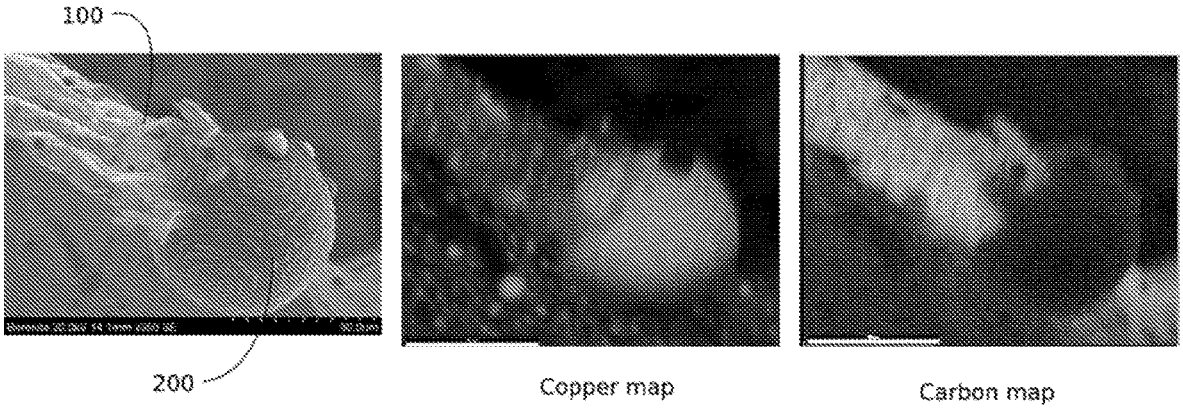
FIG. 7 shows an SEM image of a piece of CNT yarn infiltrated with a low alloy copper matrix on the left and corresponding pictures of the locations where copper was detected by Energy Dispersive X-ray Spectroscopy (EDS) analysis (copper map, center) and again with carbon (carbon map, right), in accordance with an embodiment of the invention.

FIG. 7 shows an SEM image of a piece of CNT yarn infiltrated with a low alloy copper matrix on the left and corresponding pictures of the locations where copper was detected by Energy Dispersive X-ray Spectroscopy (EDS) analysis (copper map, center) and again with carbon (carbon map, right), in accordance with an embodiment of the invention. FIG. 7 is another image of the system shown in FIGS. 5 and 6A and proves that the low alloy copper readily infiltrates a CNT yarn. The SEM image on the left shows a bead of copper 200 on the end of a piece of CNT yarn 100. The middle and right pictures are of the same area and present elemental maps of copper (middle) and carbon (right) measured by EDS. The elemental maps show good infiltration and uniform distribution of the metal inside the CNT network.

Experimental:

The following experiments were conducted to confirm the effectiveness of alloying in promoting wetting and infiltration of a nanotube yarn, in accordance with an embodiment of the invention:

1) Powders of pure copper and titanium metals were mixed in various proportions to achieve several compositions from zero to 1 wt % Ti in Cu. These powder mixtures were placed in ceramic boats inside a tube furnace and a piece of CNT yarn was placed in each boat so as to be partially immersed in the powder. The furnace was heated to melt the metal while an inert gas was flown through the furnace tube. Following the experiments, a piece of CNT yarn overhanging from each boat was collected and its microstructure was observed in an SEM. Pure copper did not wet nor infiltrate the CNT yarn. Both wetting and infiltration of the CNT yarn increased with increasing titanium content. Slight wetting but no apparent infiltration occurred with 0.5 wt % Ti in Cu, while good wetting and infiltration were observed with 1.0 wt % Ti in Cu. FIGS. 5, 6A and 7 show the results for the third experiment with a Cu-1 wt % Ti alloy. FIG. 6B shows poor wetting with insufficiently alloyed copper. The elemental maps in FIG. 7 show proof that copper from the spherical bead 200 infiltrated the CNT network 100. Note that neither vacuum nor pressure was added. The complete infiltration demonstrated in FIG. 7 was therefore achieved purely by capillary action.

2) Electroplating with Ni and Cu followed by Post-treatment:

Carbon nanotube tape about 1 cm in width and about 40 microns thick and about 2 meters long was continuously electroplated with nickel using a sulfamate electrolyte at 50° C. and a pH of 3.5 to 4. The preferred pH was 3.7. This tape could have been of any length that fit the plating fixture. The plating fixture was equipped with a supply reel, a moving rotating electrical contact in contact with the tape and a take up reel whose motion was slaved to the electrical contact through a belt drive. The anode was either nickel or copper depending on the electrolyte and surrounded the tape being coated. The thickness of the nickel was between 0.2 and 2 microns; ideally it would be about 0.5 microns. The function of the nickel was to electrically couple to the CNT and to promote wetting of a subsequent copper coating. The approximate current density was between 1 to 5 A/dm$^2$, ideally about 2 A/dm$^2$. Following the nickel coating on both sides of the tape, about 10 microns of copper was deposited in the same fixture from a copper sulfate solution with 60 parts per million of chloride ion to suppress roughness. The coating was added on both sides of the tape for a total of about 20 microns. The current density was again between 1 to 5 A/dm$^2$, preferably about 1.5 A/dm$^2$. Alternative copper plating formulations such as pyrophosphate copper or highly complex copper with EDTA or the like can be used with or without nickel present.

The now coated sample was heat-treated in a well purged tube furnace at temperatures of 1150° C. for 2 hours and allowed to cool under a continuous flow of argon. It was found the coating placed on the surface has now penetrated the CNT tape.

3) Metal Pultrusion:

CNT yarn together with metal wires were threaded through ceramic eyelets which guided the yarn and wires through a small ceramic chamber (¼" ID) placed in the middle of the hot zone in a larger (3" OD) ceramic tube in a horizontal Lindberg tube furnace. The ends of the furnace tube had sealed fittings. The spool of yarn was placed inside the fitting at the entrance, which also had ports for purge gases and control thermocouples. A sealed box containing a take-up spool mounted on a motor to provide the pulling force was mounted onto the fitting at the furnace exit. In addition to feedthroughs for controlling the motor, the box had an exhaust port for purge gases through a water bubbler. The system, including the furnace tube and exit box, was purged during the entire run with argon gas flowing through a filter to remove any residual oxygen. When the furnace reached a temperature high enough for melting the metal wires, a length of CNT yarn was pulled through the entire system, passing through the ceramic eyelets and chamber in the middle of the hot zone, and spooled in the exit chamber. Results of two of these experiments are shown in FIGS. 10 and 11.

Figure 12:
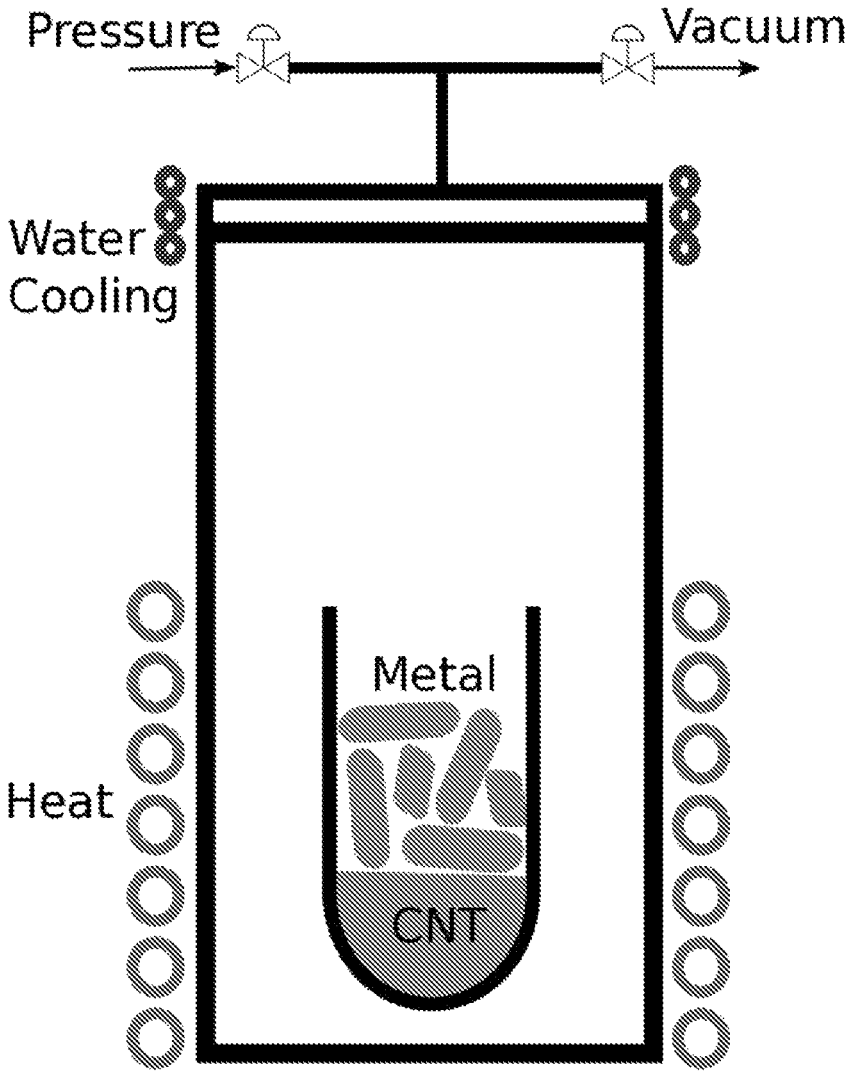
FIG. 12 is a schematic representation of a pressure infiltration apparatus used in a proof-of-concept experiment in accordance with an embodiment of the invention.

4) Infiltration in a Pressure Vessel:

A CNT preform was packed at the bottom of an alumina crucible (⅜" ID) with pieces of metal alloy placed above the preform inside the crucible. The crucible was placed inside a ¾" ID pressure vessel as illustrated in FIG. 12. The vessel was then evacuated and heated to a temperature above the melting point of the metal. After melting, the metal sealed the CNT preform in the crucible, allowing the vacuum pump to be turned off without allowing air to penetrate between interstices in the CNT preform. The chamber was pressurized with argon at 30 psi and allowed to cool down to room temperature. After removing the material from the crucible, it was found that the metal had penetrated the CNT network. It should be noted that by adding gating orifices at the top and bottom of the vessel depicted in FIG. 12 to create solidification seals and by using a CNT yarn rather than a stationary CNT preform, the infiltration setup described here can be readily adapted to implement a continuous infiltration process analogous to that taught by Blucher in U.S. Pat. No. 5,736,199 but modified to involve wetting of nanotubes with a metal.

Figure 9:
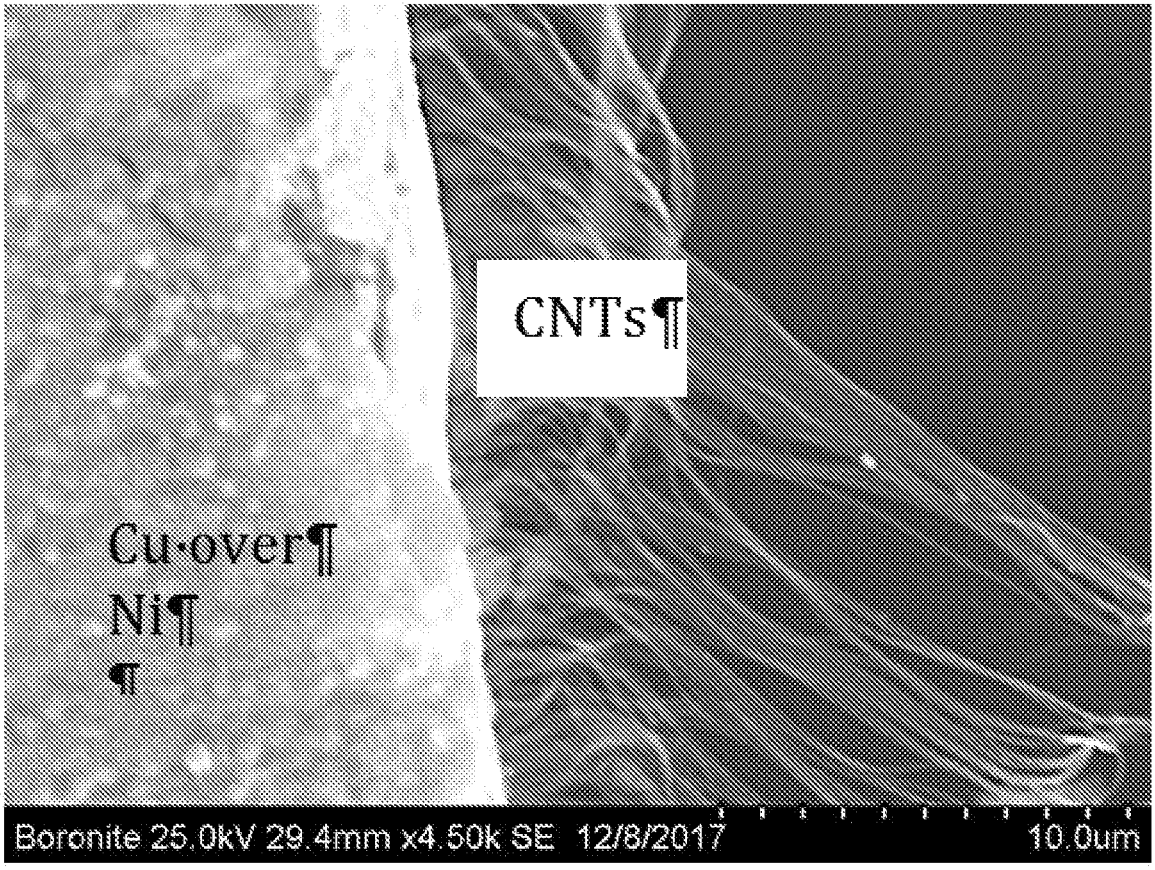
FIG. 9 is an SEM micrograph of copper and nickel electrodeposited onto a CNT tape, in accordance with an embodiment of the invention.

FIG. 9 is an SEM micrograph of a copper and nickel electrodeposited onto a CNT tape, in accordance with an embodiment of the invention. The nickel was deposited first. In accordance with an embodiment of the invention, we also posit that a copper nickel alloy with a low nickel content can be used in one step instead of this two-step process. This specimen has not yet been heat treated.

Figure 10B:
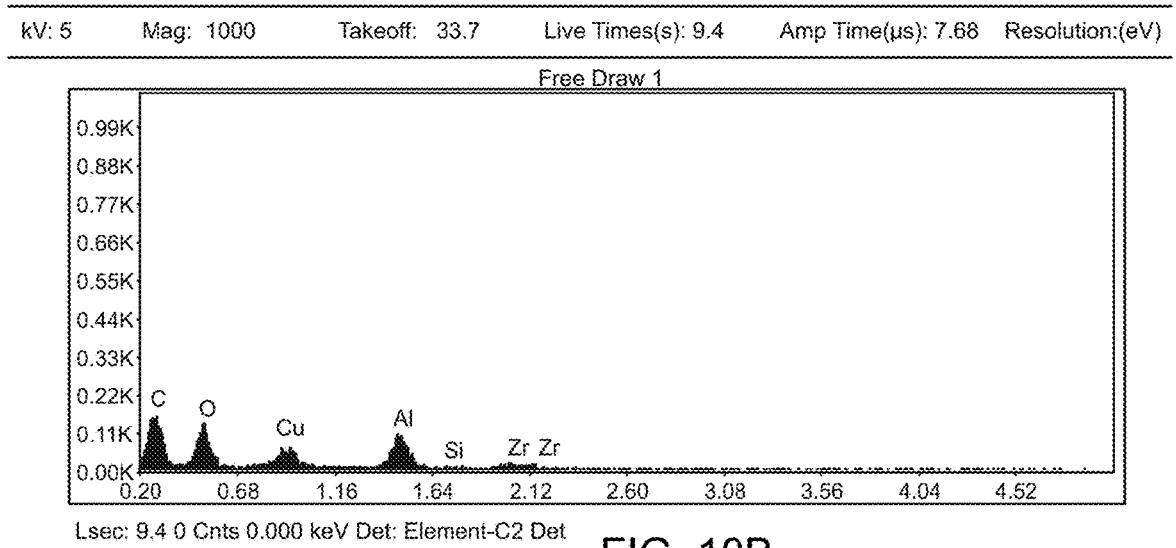
FIGS. 10A-10D are SEM micrographs (FIGS. 10A and 10C) and EDS spectra (FIGS. 10B and 10D) of a cross-section of infiltrated Superwire which remained embedded in metal, in accordance with an embodiment of the invention. This piece was pulled apart by tearing it in half along its length, revealing its internal structure.
Figure 10A:
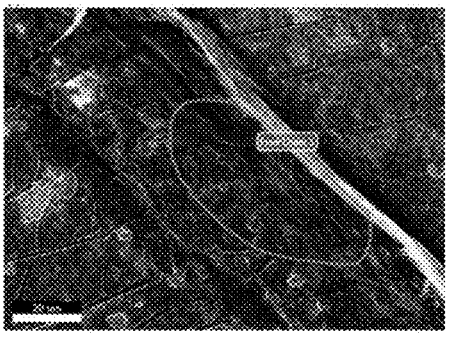
Figure 10C:
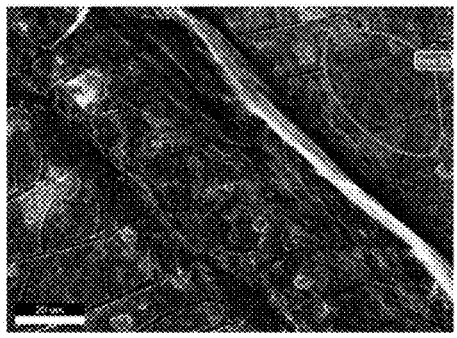
Figure 10D:
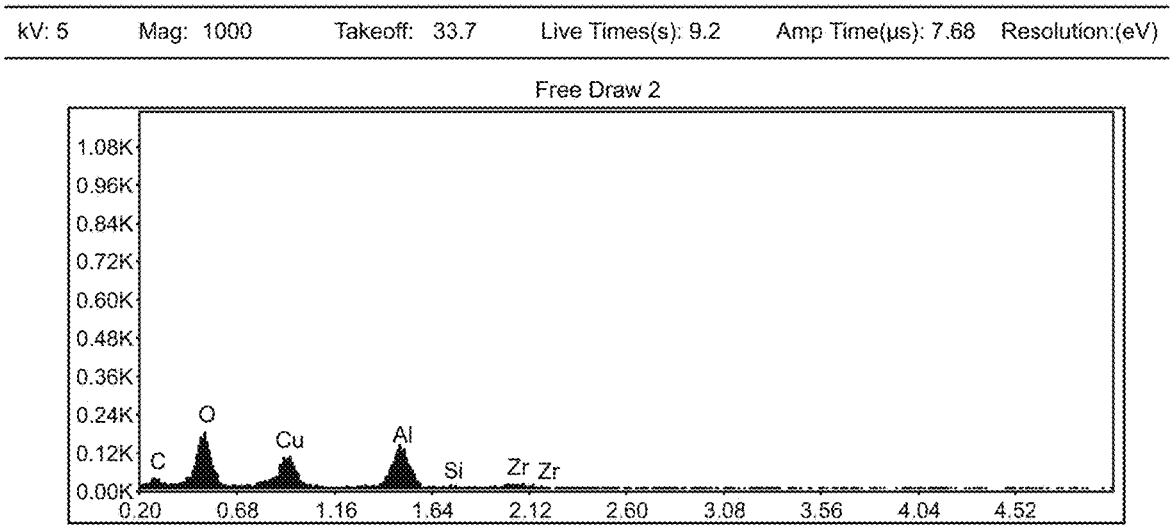

FIGS. 10A-10D are SEM micrographs (FIGS. 10A and 10C) and EDS spectra (FIGS. 10B and 10D) of a cross-section of infiltrated Superwire which remained embedded in metal, in accordance with an embodiment of the invention. FIGS. 10A and 10C are SEM pictures of a fragment of the infiltrated CNT wire left embedded in metal following pultrusion with Cu—Zr and aluminum wires. The wire was split along its length when a piece was peeled off prior to mounting for observation. The CNT yarn diameter before processing by pultrusion was approximately 100 μm while the diameter of the piece of wire in this picture following infiltration is on the order of 40 to 50 μm, indicating that a portion larger than the piece shown here was torn off and that FIGS. 10A and 10C show a view of the inside of the composite wire after processing. An EDS spectrum of the composite is presented in FIG. 10B and an EDS spectrum of the aluminum-copper (lightly alloyed with zirconium) used in this experiment, in which the composite remained embedded, measured from the background of FIG. 10A, is presented in FIG. 10D. The outline of the areas used to collect the respective spectra is shown overlaid on the pictures in FIGS. 10A and 10C. A comparison of these spectra in FIGS. 10B and 10D (notice the difference in carbon peaks and similarities in all other peaks) demonstrates that the inside of the CNT yarn was infiltrated with the metal alloy and that the overall alloy composition inside the composite is not significantly different from that of the starting metal.

Figure 11A:
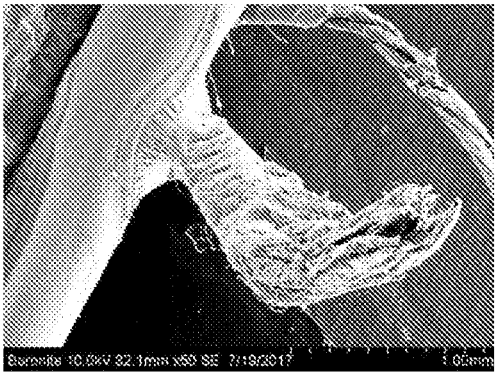
FIGS. 11A-11D are a series of SEM micrographs at increasingly high magnifications of a CNT preform fully infiltrated with a copper-titanium alloy, in accordance with an embodiment of the invention. The composite structure was trenched at 30 kV emission with a gallium focused ion beam (FIB), polished and several areas analyzed by EDS to show complete metal infiltration of the interior of the structure.
Figure 11B:
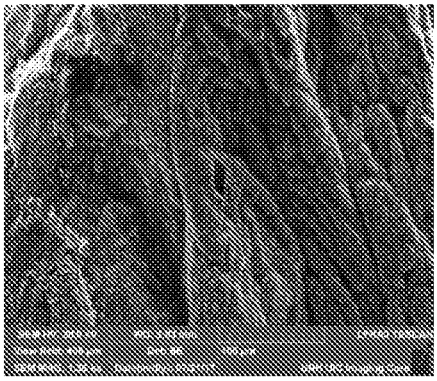
Figure 11C:
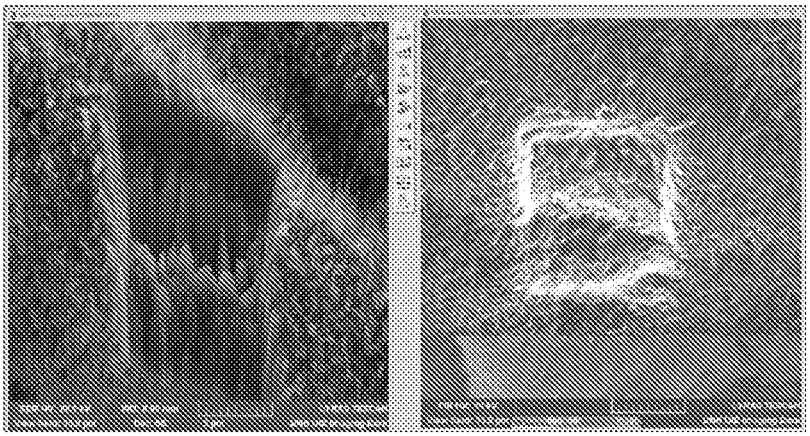
Figure 11D:
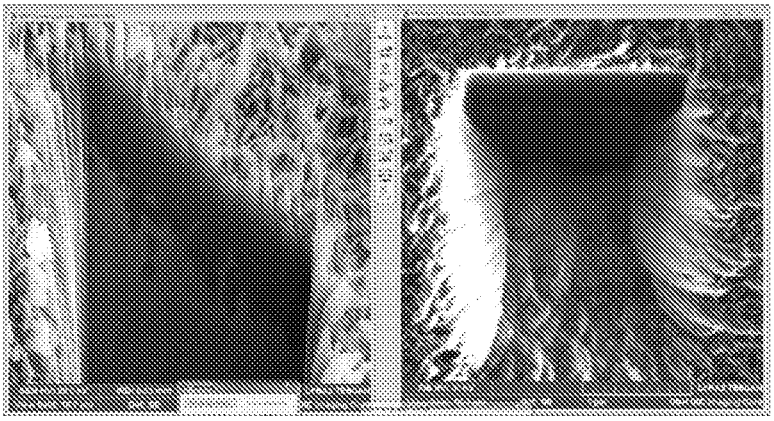

FIGS. 11A-11D are a series of SEM micrographs at increasingly high magnifications of a CNT preform fully infiltrated with a copper-titanium alloy, in accordance with an embodiment of the invention. In particular, FIGS. 11A-11D show SEM images of a CNT network, in this case a larger diameter, less tightly spun yarn than the one used in FIGS. 10A-10D, infiltrated during pultrusion processing with Cu—Zr, copper and titanium wire. The sample, shown at low magnification in FIG. 11A, was placed in a Tescan Lyra 3 SEM with a gallium FIB (Focused Ion Beam) for cutting a trench to analyze its internal composition. FIG. 11B shows the finished trench at low magnification. The images in FIG. 11C show the surface of the sample and the trench as it was being cut, while the images in FIG. 11D show details of the trench from two different angles. EDS analysis of the inside of the FIB section showed complete metal infiltration throughout the thickness of the CNT composite sample.

In accordance with an embodiment of the invention, there is produced a composite wire with minimal porosity, very high volume fraction (for example, between about 10 vol % and about 90 vol %, such as between about 55 vol % and about 70 vol %) of well-distributed nanotube reinforcement, and a strong nanotube to metal matrix interface adhesion. This is, for example, accomplished by 1) infiltrating continuous yarn formed from spun nanotubes in which the packing density of nanotube reinforcement is very high, such as between about 10 vol % and 90 vol %, for example between about 55 vol % and about 70 vol %; 2) using low levels of alloying additives (such as: Cr, Sc, Ti, V, Hf, Nb, Al, W, Mo, Ta, Ni, Co, Fe, Si, Rh or Zr) in the metal matrix to promote infiltration into the nanotube network by reducing the wetting angle with one or more of these alloying additives (although in another embodiment, discussed below, alloying is not necessary); and 3) using a high-speed liquid infiltration process in which the nanotubes are in contact with molten metal for only a short time before solidification occurs, thereby suppressing formation of any detrimental reaction phases at the nanotube/metal matrix interface.

In this embodiment of the invention, a continuous metal or metal alloy-nanotube composite wire is formed by pulling a bundle of continuously spun nanotube yarns and fine metal wires. These wires have the desired matrix composition, e.g. pure copper optionally alloyed with between about 0.5 and about 15% by weight, such as between about 0.5 and about 2% by weight, for example about 1 wt percent, of an alloying additive depending on the nature of the additive, through a hot zone then optionally subsequently through a heated die in a controlled low oxygen environment. The infiltrated, net-shape, Superwire is spooled at the exit of the process in continuous form in lengths of the same order as that of the starting yarn and metal wire bundle. The temperature gradient inside the die is controlled such that the temperature at the entrance orifice is held below the melting point of the metal and increases to exceed the melting point before the bundle exits from the die. Cooling is provided immediately past the exit point from the die in order to minimize the time the molten metal spends in contact with the nanotube reinforcement. The type of nanotube reinforcement and composition of the metal matrix will determine the processing conditions and type of environmental control required. For example, CNT yarn will oxidize in air at temperatures above 350° C. and will therefore necessitate processing in an inert environment for all MMCs of interest whereas BNNTs survive in air up to 900° C. with no detrimental effects. Al-BNNT Superwire may therefore potentially be processed in air, but Cu-BNNT will require an inert atmosphere (Aluminum's melting point: ~660° C.; Copper's melting point: 1085° C.).

In this embodiment of the invention, continuously spun nanotube yarn may also be infiltrated by touching the moving yarn to a molten surface or exposing it to a vapor, or immersing it in a molten metal alloy and then passing it through a die, followed by quick cooling to cause solidification of the matrix. Similar precautions to exclude oxygen must be taken.

Infiltration by other methods known to be able to coat nanotube wires are envisioned in this embodiment including, but not limited to: (1) electrochemical coating of copper nickel alloys from aqueous electrolytes, organic electrolytes or fused salts, or displacement reactions; (2) sputtering; (3) plasma coating; (4) powder infiltration combined with melting; (5) physical vapor deposition. Some of these processes could be conducted on individual nanotubes prior to yarn formation and others would involve coating yarns. All of these are followed by heating to melt the metal alloy and infiltrating the coating whose composition is designed to wet the nanotubes (CNT, BNNT or BNT) into the nanotube structure. In some cases the alloy coating may be useable as is without melting. Any alloy that can be electrochemically produced is considered by this invention including gold-cobalt, copper-cobalt, copper-nickel, aluminum (from eutectic salts), silver-nickel, silver cobalt and the like.

In another embodiment according to the invention, alloying is not necessary. For example, although copper does not readily wet reinforcements such as carbon or alumina, some metals may not require alloying. For example, metals such as aluminum, which offer better wetting of reinforcements, may not require alloying. In one embodiment according to the invention, a technique based on that of U.S. Pat. No. 5,736,199 of Blucher (the entire teachings of which are incorporated by reference herein) may be used, but modified in order to involve wetting of nanotubes with a metal. For example, in an embodiment according to the invention, a nanotube (such as CNT, BNNT, BNT or another nanotube or carbon fiber), may be continuously infiltrated with a metal, such as pure aluminum or another pure metal, without requiring alloying, by using a technique based on that of U.S. Pat. No. 5,736,199 of Blucher modified to continuously infiltrate a molten metal into nanotubes. Alternatively, alloying elements can be chosen to suppress reactions with the carbon that are not wanted: for example silicon can suppress the reaction between carbon nanotube yarn and aluminum (21).

In a further embodiment of this invention we infiltrate nanotube tapes or yarns in one of the methods described above to be able to create a metal prepreg with a slight excess of metal alloy. These prepregs can be consolidated into a net shape structure by filament or tape winding followed by hot isostatic compaction (or hot pressing, sintering, laser sintering or hot compaction sufficient to melt the alloy) or self-heating by passing a current through the nanotube yarn. A consequence of an embodiment according to the invention is that one can create a metal matrix composition with a high (potentially an almost ideal) density using CNT, BNNT, or BNT, with the nanotubes aligned along the fiber axis.

Up to the time of the present invention, the reinforcement fraction of these nanotube metal-matrix products has been very limited because of the difficulty of nanotube dispersion due to viscosity and other effects including reactions at the interfaces. Typical composite CNT concentrations are usually less than 20% and in many cases less than 1%. Using infiltration technology, in accordance with an embodiment of the invention, it should be possible to obtain values in excess of, for example, 50%, with a profound impact on properties.

A consequence of this embodiment is the ability to engineer the coefficient of thermal expansion in the direction of the fiber, improve fatigue behavior and increase strength and elastic modulus. Applications might include body and other armors, and structures for satellites that are simultaneously shielding, thermal and structural. An additional consequence of this embodiment is the ability to infiltrate a standalone preformed structure made of nanotubes.

Figure 8:
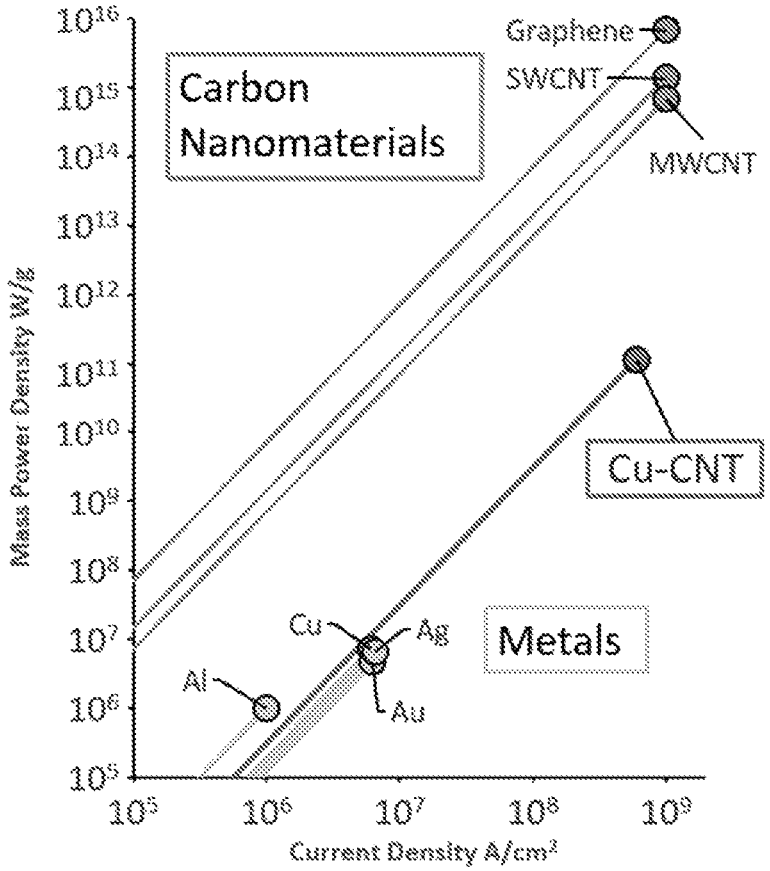
FIG. 8: A graph of the specific energy required to achieve ampacity for a variety of different materials, showing a comparison with predicted performance of a copper Superwire in accordance with an embodiment of the invention.

FIG. 8 is a graph of the specific energy required to achieve ampacity for a variety of different materials, showing a comparison of prior art materials with predicted performance of a copper Superwire in accordance with an embodiment of the invention (marked "Cu-CNT"). The "Cu-CNT" data point is a prediction for a copper Superwire, in accordance with an embodiment of the invention, based on literature data (see Subramaniam ref. (3)). Note that even though graphene or individual CNTs of the prior art can achieve high ampacity, these materials are not in a continuous wire format and furthermore orders of magnitude more energy is required to drive current through these conductors than through an embodiment according to the present invention, the copper-CNT Superwire.

In another embodiment according to the invention, one or more of Cr, Sc, Ti, V, Hf, Nb, Al, W, Mo, Ta, Ni, Co, Fe, Si, Rh or Zr, can be added to a melt of copper (or another metal) in order to help disperse graphene within the copper (or aluminum or another metal), in a modification of the Covetics process referred to above. Adding one or more of the foregoing elements may assist to make alloys that are uniform and which can be extruded into wires in a low-cost mass production process. As noted above, a Covetics alloy may be, for example, an alloy of carbon black with copper created by blending in the melt stage but starting with pure, unalloyed copper. These alloys of copper and graphene (18) were discovered after electrolyzing molten solutions of copper and carbon black at very high current. In accordance with an embodiment of the invention, one or more of Cr, Sc, Ti, V, Hf, Nb, Al, W, Mo, Ta, Ni, Co, Fe, Si, Rh or Zr, can be added to a melt of copper (or another metal), in a modification of the Covetics process. Other Covetics processes to which such elements (that is, one or more of Cr, Sc, Ti, V, Hf, Nb, Al, W, Mo, Ta, Ni, Co, Fe, Si, Rh or Zr) can be added include those taught in one or more of the following references, the entire teachings of which are hereby incorporated herein by reference: U.S. Patent App. Pub. No. 2010/0327233, December 2010; U.S. Patent App. Pub. No. US2012/0009110, January, 2012, which relates to gold, silver, tin, lead, and zinc; U.S. Patent App. Pub. No. US2012/0244033, in September 2012, which relates to aluminum; U.S. Patent App. Pub. No. 2017/0298476 A1, Oct. 19, 2017, "Multi-Phase Covetic and Methods of Synthesis Thereof"; Salamanca-Riba, et al., "A New Type of Carbon Nanostructure Formed Within a Metal-Matrix," Nanotech 2012, Santa Clara, Calif., 18 Jun. 2012, CRC Press; Forrest, et al., "Novel Metal-Matrix Composites with Integrally-Bound Nanoscale Carbon," Nanotech 2012, Santa Clara, Calif., 18 Jun. 2012, CRC Press; and Mete Bakir, Iwona Jasiuk* Novel metal-carbon nanomaterials: A review on Covetics 2017, 8(9), 884-890 Advanced Materials Letters.

In accordance with an embodiment of the invention, we posit that, by adding minority concentrations of the linker or alloying elements Cr, Sc, Ti, V, Hf, Nb, Al, W, Mo, Ta, Ni, Co, Fe, Si, Rh or Zr to a large amount of molten copper, this copper alloy will uniformly wet any carbon (carbon-black, graphene, nanotubes carbon fiber) added to this melt. In this embodiment, instead of passing a carbon (CNT) fiber through molten copper, the carbon is added to the melted copper (or other metal) and left there.

The Covetics fabrication process requires very high energy to enable the graphene to bond to copper. The graphene is derived normally from carbon black, although it may be added directly. In accordance with an embodiment of the invention, we teach that the linker or alloying elements (Cr, Sc, Ti, V, Hf, Nb, Al, W, Mo, Ta, Ni, Co, Fe, Si, Rh or Zr) can greatly reduce the energy for bonding so that copper can attach to graphene planes (or other carbon source). In most cases the bonding energy is exothermic so that the elements (Cr, Sc, Ti, V, Hf, Nb, Al, W, Mo, Ta, Ni, Co, Fe, Si, Rh or Zr) will spontaneously react in the absence of oxygen (say at 1085° C.) if they are dissolved in copper as a minority constituent.

Based on the use of one or more of Cr, Sc, Ti, V, Hf, Nb, Al, W, Mo, Ta, Ni, Co, Fe, Si, Rh or Zr in a Covetics type process, in accordance with an embodiment of the invention, there is provided:

1. a uniform copper-(Cr, Sc, Ti, V, Hf, Nb, Al, W, Mo, Ta, Ni, Co, Fe, Si, Rh or Zr) alloy that has highly uniform composition.
2. a uniform copper Covetics alloy that lends itself to be drawn into continuous copper wire in a low-cost process that takes advantage of existing wire drawing infrastructure.
3. a uniform aluminum alloy-(with Cr, Sc, Ti, V, Hf, Nb, Al, W, Mo, Ta, Ni, Co, Fe, Si, Rh or Zr) that has uniform composition.
4. a uniform copper alloy (with Cr, Sc, Ti, V, Hf, Nb, Al, W, Mo, Ta, Ni, Co, Fe, Si, Rh or Zr) that can be cast, extruded, drawn, forged into bus bars or the like.
5. a process to fabricate a copper-Covetics (silver, aluminum or gold) alloy.
6. a process whereby a molten copper alloy is created by small additions of elements from (Cr, Sc, Ti, V, Hf, Nb, Al, W, Mo, Ta, Ni, Co, Fe, Si, Rh or Zr).

In accordance with another embodiment of the invention, a process of coating dual layers metals onto nanotubes may be used, as described in more detail below. In one example, one or more of Cr, Sc, Ti, V, Hf, Nb, Al, W, Mo, Ta, Ni, Co, Fe, Si, Rh or Zr may be coated onto the CNT or carbon substrate in a first layer, followed by a second layer of copper deposition. Such dual layer processes can, for example, create difficult-to-fabricate alloys by first coating one metal, then another metal, followed by heating, in order to give the same results as is provided by processes described above. Alternatively, a dual layer process can involve leaving the dual layer of coatings without heat treatment, which may be beneficial in some cases where ampacity is not limited by electromigration, and where one or more elements from Cr, Sc, Ti, V, Hf, Nb, Al, W, Mo, Ta, Ni, Co, Fe, Si, Rh or Zr help to electronically couple the CNT crystal to the copper crystal.

In more detail, in accordance with a dual layer embodiment of the invention, one or more of the metals Cr, Sc, Ti, V, Hf, Nb, Al, W, Mo, Ta, Ni, Co, Fe, Si, Rh and Zr can be coated onto nanotube (such as CNT) yarn or wire, by any coating technology capable of coating (electroplating, sputtering, MBE, CVD etc.) directly on the CNT structure and subsequently copper (or Ag or other metal) can then be coated on top of these metals. This dual layer coated substrate then can be optionally heated to produce by diffusion the same sort of microstructure as discussed above but now advantageously bypassing the molten alloy metal stage. Alternatively, these dual coated microstructures can be used to carry current with reduced resistivity and without heating. Alternatively, only one of these metals might be used.

In a process in accordance with one embodiment of the invention, one or more of the metals taken from the series, Cr, Sc, Ti, V, Hf, Nb, Al, W, Mo, Ta, Ni, Co, Fe, Si, Rh or Zr are placed as a thin coating on a CNT wire. A second coating of copper (or Ag or another metal) is then placed on top of this first wetting/linker/bonding layer to produce a dual layer metallic coating on a continuous CNT wire. It is understood that many combinations of metals from the series, Cr, Sc, Ti, V, Hf, Nb, Al, W, Mo, Ta, Ni, Co, Fe, Si, Rh or Zr, can also be used.

In another embodiment in accordance with the invention, a dual metal layer from the group consisting of Cr, Sc, Ti, V, Hf, Nb, Al, W, Mo, Ta, Ni, Co, Fe, Si, Rh or Zr coated with substantially pure copper (90% or greater) is coated onto a continuous CNT wire or yarn, where continuous is any yarn more than 5 meters in length. Another embodiment comprises the interdiffused alloy composite that results when materials comprising the dual metal layer in the preceding sentence are heated to enable infiltration into the CNT structure of the metals from the group consisting of Cr, Sc, Ti, V, Hf, Nb, Al, W, Mo, Ta, Ni, Co, Fe, Si, Rh or Zr together with copper or other metal.

Another embodiment according to the invention comprises the interdiffused alloy composite that results when one or more of the materials Cr, Sc, Ti, V, Hf, Nb, Al, W, Mo, Ta, Ni, Co, Fe, Si, Rh or Zr only are coated onto a carbon structure (such as CNT yarn, graphene yarn, carbon fiber or the like) and then heated.

In another embodiment in accordance with the invention, any of the nanotubes taught herein can be doped, for example with small amounts of other atoms, to adjust properties. For example, carbon can be added to Boron Nitride Nanotubes (BNNTs) to make the nanotubes more conductive.

Definitions

As used herein and in the appended claims, a "carbon nanotube" (or "CNT") is a graphene plane rolled up into a tube capped with a half of a Bucky sphere at one end and usually a magnetic transition metal catalyst at the other. This graphene plane is characterized by $sp^2$ hybridized bonding which gives the surface its hexagonal symmetry, very good electronic properties, high strength, and a modulus of about 1 TPa. These properties clearly distinguish CNTs from carbon fibers. They have a diameter range from about 0.8 nm to over 100 nm, typically ranging from about 1 to 10 nm. The length of these tubes spans from a few microns to many millimeters and occasionally to 20 or more centimeters. More typically they are about 1 or 2 millimeters in length. The tubes can be a single wall of graphene or dual wall or multiwalls. Very small diameter tubes, say less than 5 nm, are typically single walls. Depending on their structure (diameter and graphene plane configuration) they can conduct electricity as a metal or a semiconductor. They are black.

As used herein and in the appended claims, a "boron nitride nanotube" (or "BNNT") is a well-ordered structure of alternating boron and nitrogen atoms forming a hexagonal plane rolled up into a tube. BNNTs are very different from CNTs and their cap shape is more complex. They too can have a catalyst on the other end. Catalysts can be a metallic transition metal or boron. Their diameters span 1 nm to over 100 nm and their lengths range from a few microns to millimeters. These tubes have both $sp^2$ bonding as well as an ionic character which causes their surface to be corrugated. This in turn affects their self-friction. They are insulators and possess piezoelectric characteristics, have high strength, and a modulus close to 1 TPa. They have much better thermal and chemical stability than CNTs. They are white.

As used herein and in the appended claims, a "boron carbo-nitride nanotube" (or "BCN-NT"), can be thought of as BNNT in which some B and N atoms have been substituted with carbon atoms. The addition of carbon has profound effects on the electronic properties and color of the nanotubes. Increasing the relative proportion of carbon changes these materials from strong insulators at low (a few percent) carbon content to good conductors at high (for example 90%) carbon content. These are also nanotubes and have structures similar to CNTs and BNNTs. Their color is grey.

As used herein and in the appended claims, a "boron nanotube" (or "BNT") is formed by a rolled-up sheet of buckled triangular arrangements of boron atoms because a graphitic hexagonal lattice of B atoms is unstable. After relaxation, the surface of a BNT remains flat. Simulations predict most BNTs to be metallic regardless of chirality. Small carbon additions may increase stability and improve conductivity. BNTs can be grown from magnetic transition metal catalysts like CNTs and have the potential to exceed the electrical conductivity of carbon structures (CNTs).

As used herein and in the appended claims, a "yarn" (made from nanotubes) is a continuous strand of twisted nanotubes or bundles or fibrils of nanotubes, used in weaving or knitting textiles or as fiber reinforcement in composites or as electrical conductors. The yarns may be plied together to make larger fibers, wires or cables. The adhesion between the relatively short nanotubes (millimeters in length or less) derives from the surface interactions between tubes and from the twist imparting a capstan effect that increases frictional forces.

As used herein and in the appended claims, a "tape" or "continuous nanotube tape" is usually a non-woven structure of nanotubes held together by electrostatic forces and by entanglement between the tubes. It can be produced in situ during growth or be cut from a large sheet and be bonded together with an adhesive to produce a continuous structure. The width of a tape can run from 0.5 cm to about 10 cm, its thickness can range from about 2 microns to about 200 microns, typically about 50 microns. Alternatively, tapes can be woven from aligned yarns.

As used herein and in the appended claims, a "sheet" or "continuous nanotube sheet" is a wide tape produced in a batch system and bonded to another tape to constitute a continuous sheet (thousands of feet long) or it can be produced on a machine in a continuous manner. These structures are typically non-woven, their width ranges from about 10 cm to about 500 cm, their thickness ranges from about 2 microns to about 200 microns. Alternatively, continuous nanotube sheet or fabric can be woven from nanotube yarns in a manner known to the textile industry.

As used herein and in the appended claims, "high-quality nanotubes" means nanotubes with a minimal number of structural or crystallographic defects, such as for example Stone-Wales defects. "Highly conductive nanotubes" means nanotubes with fewer than one defect for every ten microns in length and whose length is larger than the mean free path of about ten microns.

As used herein and in the appended claims, "interdiffused alloy" means a metal formed of more than one element in which the structure and equilibrium composition is formed by diffusion of the atoms, typically at temperatures below the melting point of one of the elements.

As used herein and in the appended claims, "infiltration" means substantially filling the void spaces between the carbon reinforcement (such as between nanotubes or nanotube bundles) with a metal or alloy matrix.

In accordance with an embodiment of the invention, there are provided inventions in accordance with the following numbered Statements:

Statements:

1. A metal matrix composite comprised of a continuous wire, continuous tape, sheet or a preformed nanotube shape consisting of: (1) a pure metal or combinations of metals such as copper, aluminum, silver or gold, tin, cobalt, nickel, iron and (2) nanotube reinforcements with about 10% up to about 90% by volume, such as between about 40% by volume and about 60% by volume, for example comprising (such as, consisting of) carbon nanotubes (CNT), or boron nitride nanotubes (BNNT) or boron nanotubes (BNT) or other nanotubes.

2. The composite of Statement 1 where the copper alloying or linker elements may include small amounts of Cr, Sc, Ti, V, Hf, Nb, Al, W, Mo, Ta, Ni, Co, Fe, Si, Rh, or Zr and others, when known in combination, to wet the nanotube fibers and or to suppress unwanted surface reactions for example silicon to suppress carbide formation in aluminum or nickel to help wet CNT nanotubes surfaces.

3. The composite of Statement 2 where the compositions of the alloying elements can vary according to the application, typically from about 0.5 to 15% by weight. Their optimal composition will vary from metal to metal but generally is chosen to be enough to wet but not high enough to have a detrimental effect on the electrical and thermal properties. For example copper might be alloyed with 2% of chromium or with 1% of Zirconium by weight.

4. A copper or aluminum matrix composite yarn, wire or fiber structure of any preceding Statements, consisting of a high volume fraction of continuously spun nanotube yarns, typically between about 10% and about 90% by volume, preferably carbon nanotube yarns embedded in a metal matrix of a copper or aluminum alloy. The aluminum alloy can be substantially pure, and the copper can be minimally alloyed with elements usually less than 2%. Nanotubes tend to form bundles of between 20 and 50 nm and in some cases it is the bundles, rather than each individual nanotube, that may be surrounded by the matrix (copper alloy).

5. A copper alloy coated onto a CNT yarn or tape or sheet. The copper alloy may or may not fully infiltrate all interstices within the bulk of the nanotube preform. The alloying element is selected from Statement 2.

6. A dual coating on a CNT yarn or tape or sheet consisting of the first coating designed to wet the CNT for example nickel or cobalt, and the second copper.

7. The infiltrated metal matrix composite created by heating the metal matrix composite of Statement 5 or Statement 6 sufficiently to cause the metal to substantially fill space around the CNT and or the CNT bundles.

8. The method of processing the fibers of Statement 4 by infiltrating the CNT fiber with copper or aluminum alloy continuously at high speed.

9. The composite of Statement 4 where the nanotube is a carbon nanotube continuous yarn or tape and the molten infiltrate is a copper-titanium alloy with between 0.1% and 5% weight percent titanium preferably about 1 percent by weight.

10. A process for coating the composite of Statement 1-4, 6, comprising: (1) passing a CNT yarn over/under pulleys through a molten matrix alloy. As the yarn moves through the molten metal, the alloy infiltrates pores by capillary action creating a pre-impregnated MMC yarn. Following this step, the infiltrated yarn passes through a heated die assembly. Both portions of the die are heated to a temperature slightly exceeding the melting point of the metal to prevent premature solidification of the matrix. As yarn moves through the die excess metal gets squeezed. The entire apparatus is kept inside a hermetically sealed enclosure, which suppresses oxidation of the CNT and of the matrix.

11. A method of precisely combining the constituents of the composite of any preceding Statement where an alloy wire of the desired composition and volume of pre-measured alloy is wrapped or braided around a nanotube fiber then heated in a protective atmosphere and pulled through a heated die to melt and infiltrate the nanotube fiber with exactly the correct amount of alloy.

12. The method of Statement 10 whereby the alloyed wire is woven or braided into a textile structure that, when heated, will exactly infiltrate all the fibers within the braid.

13. A method to pre-coat the nanotube fibers of any preceding statement, prior to heating consisting of (1) electrochemical coating from aqueous electrolytes, organic electrolytes or fused salts, or (2) sputtering the correct alloy composition, or (3) plasma coating, or (4) powder infiltration or (5) physical vapor deposition coating.

14. A method for heating the wires of Statement 10 consisting of heating the pre-impregnated and alloy coated fibers by: (1) heating in a tube furnace, (2) laser heating, (3) plasma heating or (4) resistive heating.

15. A method of any preceding Statement whereby the CNT, BNNT or BNT yarns are braided using 3 to more than 30 different fibers in a commercial braiding machine with specially made alloy wires to produce a cable or hollow tube. These structures can be consolidated by methods of Statements 10, 13 and 14. Alternatively premade alloy infiltrated fibers of different nanotube types can be braided together to provide a braided yarn or cable with specific characteristics. This method can also be used to form hollow tubes for use at very high ampacities which, following heat treatment, can be water-cooled through their core.

16. In a second embodiment of this invention one can infiltrate nanotube tapes (or yarns) in one of the methods described above to be able to create a metal matrix composite prepreg with a slight excess of metal alloy. These prepregs can be consolidated into a net shape structure by filament or tape winding followed by hot isostatic compaction (or hot pressing, sintering, laser sintering, hot compaction or resistive heating sufficient to melt or thermally form the alloy). The consequence of an embodiment is that one can create a metal matrix composition with a high (such as an almost ideal) reinforcement density using nanotubes such as CNT, BNNT, or BNT, with the nanotubes aligned along the fiber axis. In this embodiment melting is not necessary.

17. The composite in accordance with any of the preceding statements can be processed by a commercial wiring company to insulate and attach connectors to in any manner commonly known to manufacturers of electrical cables.

18. Applications, in accordance with an embodiment of the invention, can include:

a. Superwire: Cu—Ti with CNT or any of the other embodiments herein.

b. Metal matrix composites with copper, silver, gold, lead, tin, zinc, nickel, iron, cobalt with high volume fractions of nanotube.

c. Improve conductivity, strength and reduce weight of lead acid battery electrodes d. Improve conductivity, strength and reduce weight of Zinc battery electrodes: CNT and Zinc e. Improve conductivity, strength and reduce weight of Tin battery electrodes: CNT and Tin f. Radiation (neutron) shielding: BNNT or BNT and any matrix g. Electrostatic discharge (ESD) shielding: CNT and any matrix h. Composite to engineer coefficient of thermal expansion (CTE) and carry heat away from a die or other heat generating element without cracking of the interface.

i. Impart damping characteristics to MMCs used for structural applications.

j. Wiring for motors, alternators and generators, solenoids used for automotive and aerospace field.

k. Wiring for use in high current pulse applications and especially for wiring that has to be very strong, l. Wiring for high voltage power transmission lines.

m. Wiring that has to be extremely thin n. Wiring that has to survive in extreme high temperatures and/or corrosive environments for example wiring in batteries or wiring to be used in undersea cables or wiring used in oil wells.

o. Wiring that has to be very fatigue resistant, p. Wiring for use in antennas q. Wiring for use in very high ampacity applications such as rail gun cables, printed circuit boards or chip wiring, r. Composite materials used in high energy plasma housings or rail gun rails s. As a direct die attach heat sink to replace Cu—W.

t. for wiring within the human body that has to be very corrosion resistant for example to power embedded batteries, nerve actuation and to connect to sensors.

19. A process whereby one or more of the metals taken from the series, Cr, Sc, Ti, V, Hf, Nb, Al, W, Mo, Ta, Ni, Co, Fe, Si, Rh or Zr are placed as a thin coating on a CNT wire. A second coating of copper (Ag or other metal) is then placed on top of this first wetting/linker/bonding layer to produce a dual layer metallic coating on a continuous CNT wire. It is understood that many combinations of metals from the series, Cr, Sc, Ti, V, Hf, Nb, Al, W, Mo, Ta, Ni, Co, Fe, Si, Rh or Zr, can also be used.

20. A dual metal layer from the group consisting of Cr, Sc, Ti, V, Hf, Nb, Al, W, Mo, Ta, Ni, Co, Fe, Si, Rh or Zr coated with substantially pure copper (90% or greater) coated onto a continuous CNT wire or yarn. Continuous is any yarn more than 5 meters in length.

21. The interdiffused alloy composite that results when materials of Statement 20 are heated to enable infiltration into the CNT structure of the metals from the group consisting of Cr, Sc, Ti, V, Hf, Nb, Al, W, Mo, Ta, Ni, Co, Fe, Si, Rh or Zr together with copper or other metal.

22. The interdiffused alloy composite that results when one or more of the materials Cr, Sc, Ti, V, Hf, Nb, Al, W, Mo, Ta, Ni, Co, Fe, Si, Rh or Zr only are coated onto a carbon structure (CNT yarn, graphene yarn, carbon fiber or the like) then heated.

PATENT REFERENCES

An embodiment according to the invention can utilize one or more methods and materials, in addition to the above methods or in combination with the above materials, that are taught in the following patent references, the teachings of which are incorporated by reference in their entirety:

1. Joseph T. Blucher U.S. Pat. No. 5,736,199
2. Joseph T. Blucher, Makoto Katsumata, U.S. Pat. No. 6,629,557 B2
3. Joseph T. Blucher U.S. Patent App. Pub. No. 2005/0061538A1
4. Ott; John A. (Greenwood Lake, N.Y.), Bol; Ageeth A. (Yorktown Heights, N.Y.) U.S. Pat. No. 9,000,594
5. Nayfeh; Taysir H. (Cleveland, Ohio), Wiederholt; Anita M. (Sheffield Village, Ohio) U.S. Pat. No. 8,347,944
6. Shugart; Jason V. (Waverly, Ohio), Scherer; Roger C. (Portsmouth, Ohio), Penn; Roger Lee (Hedgesville, W. Va.) U.S. Pat. No. 9,273,380 (Aluminum)
7. Shugart; Jason V. (Waverly, Ohio), Scherer; Roger C. (Portsmouth, Ohio) U.S. Pat. No. 8,647,534 (Copper)
8. Shugart; Jason V. (Waverly, Ohio), Scherer; Roger C. (Portsmouth, Ohio) U.S. Pat. No. 8,551,905 (Gold)
9. Shugart; Jason V. (Waverly, Ohio), Scherer; Roger C. (Portsmouth, Ohio) U.S. Pat. No. 8,546,292 (Zinc)
10. Shugart; Jason V. (Waverly, Ohio), Scherer; Roger C. (Portsmouth, Ohio) U.S. Pat. No. 8,541,336 (tin)
11. Shugart; Jason V. (Waverly, Ohio), Scherer; Roger C. (Portsmouth, Ohio) U.S. Pat. No. 8,541,335 (lead)
12. Materials and Methods for Insulation of Conducting Fibres, and Insulated Product, U.S. Patent App. Pub. No. 2014/0231118 A1 Krzysztof K. K. Koziol, Agnieszka Ewa Lekawa-Raus, Lukasz Kurzepa, Xiaoyu Peng

OTHER REFERENCES (1) Google search for "CNT coaxial cables in space"
(2) A. R. Hopkins, A. C. Labatete-Goeppinger, H. Kim, H. A. Katzman, "Space survivability of carbon nanotube yarn material in low Earth orbit", Carbon 107 (2016) 77-8. DOI: 10.1016/j.carbon.2016.05.040
(3) Chandramouli Subramaniam, Takeo Yamada et. al. Nature Communications 4, Article number:2202 (2013) doi:10.1038/ncomms3202
(4) Li, P.-C. & Young, T. K. Electromigration: the time bomb in deep-submicron ICs. IEEE Spectrum 33, 75-78 (1996).
(5) Lloyd, J. R. & Clement, J. J. Electromigration in copper conductors. Thin Solid Films 262, 135-141 (1996).
(6) Tao, J. & Cheung, N. W. Electromigration characteristics of copper interconnects. IEEE Electr. Device L. 14, 249-251 (1993).
(7) Naeemi, A. & Meindl, J. D. Compact physical models for multiwall carbon-nanotube interconnects. IEEE Electr. Device L. 27, 338-341 (2006).
(8) O. Hjortstam, P. Isberg, S. Söderholm and H. Dai, "Can We Achieve Ultra-Low Resistivity in Carbon Nanotube-Based Metal Composites?, Appl. Phys. A, Vol. 78, Issue 8, 2004, 1175-1179
(10) Zhang, S. Chen, "Electronic Structure and Transport Properties of Carbon Nanotube Adsorbed with a Copper Chain" International Journal of Nanoengineering and Nanosystems, 227, Issue 3 (September 2013) 115-119: Peng, Y. and Q. Chen, "Fabrication of Copper/Multiwall Carbon Nanotubes Hybrid Nanowires Using Electroless Copper Deposition Activated with Silver Nitrate", Journal of the Electrochemical Society, 159 Issue 2 (2012) D72-D76
(11) EC FP7 UltraWire project
(13) Chen Quanfang, Chai Guangyu, Li Bo. Exploration study of multifunctional metallic nanocomposite utilizing single-walled carbon nanotubes for micro/nano devices. J Nanoeng Nanosyst 2006; 219:67-72.
(14) Sun Ying, Chen Quanfang. Diameter-dependent mechanical strength of carbon nanotubes reinforced composite. Appl Phys Lett 2009; 95:021901-3.
(15) Chai Guangyu, Sun Ying, Sun Jianren, Chen Quanfang. Mechanical properties of carbon nanotube-copper nanocomposites. J Micromech Microeng 2008; 18:035013.
(16) Ibid 3
(18) D. R. Forrest, et al., "The Production and Properties of Copper and Aluminum Covetic Nanomaterials", MS&T'14, Pittsburgh, Pa., Oct. 15, 2014. D. R. Forrest, et al., "Novel Metal-Matrix Composites with Integrally-Bound Nanoscale Carbon", Nanotech 2012, Santa Clara, Calif., Jun. 18, 2012. D. R. Forrest, et al., "Nanoscale Carbon in Metals for Energy Applications", MS&T '12, Columbus, Ohio, Oct. 19, 2012. T. Knych, et al., "Fabrication and Cold Drawing of Copper Covetic Nanostructured Carbon Composites", Arch. Metallurgy and Materials, 59(4), 1283, 2014

(19) L. Salamanca-Riba, et al., "A New Type of Carbon Nanostructure Formed Within a Metal-Matrix", Nanotech 2012, Santa Clara, Calif., Jun. 18, 2012

(20) L. Pryor et al., GE Industrial White Paper (2008).

(21) N. Frage, L. Levin, N. Frumin, M. Gelbstein, M. P. Daniel, Journal of Materials Processing, Technology Volumes 143-144, 20 Dec. 2003, Pages 486-490.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

What is claimed is:

1. A metal matrix composite, the composite comprising:

an alloy of copper of at least about 90% purity with between about 0.5% by weight and about 15% by weight of a second metal comprising at least one of: chromium, scandium, titanium, vanadium, hafnium, niobium, aluminum, tungsten, molybdenum, tantalum, nickel, cobalt, iron, silicon, ruthenium and zirconium;

a plurality of nanotube reinforcements present in a volume fraction of between about 40% by volume and about 60% by volume of the metal matrix composite, the plurality of nanotube reinforcements comprising at least one of carbon nanotubes, boron nitride nanotubes, boron nanotubes, boron carbo-nitride nanotubes, silicon nanotubes, titanium oxide nanotubes and gallium nitride nanotubes;

wherein the plurality of nanotube reinforcements comprises a continuously spun nanotube yarn or a continuous nanotube tape, the continuously spun nanotube yarn or continuous nanotube tape being embedded in a matrix of the alloy; and the alloy wetting the plurality of nanotube reinforcements such that the alloy is in electrical contact with the nanotube reinforcements whereby beads of the alloy form a contact angle of less than 90 degrees with nanotubes of the plurality of nanotube reinforcements.

2. The metal matrix composite of claim 1, comprising between about 0.5% by weight and about 2% by weight of the second metal.

3. The metal matrix composite of Claim 1, wherein the continuously spun nanotube yarn or the continuous nanotube tape comprises a carbon nanotube continuous yarn or tape, and wherein the alloy comprises a copper-titanium alloy comprising between about 0.1% by weight titanium and about 5% by weight titanium.

4. The metal matrix composite of claim 1, wherein the plurality of nanotube reinforcements comprises a continuously spun nanotube yarn or a continuous nanotube tape, and wherein the second metal comprises substantially pure aluminum.

* * * * *